United States Patent [19]

Jageler et al.

[11] 4,354,558

[45] Oct. 19, 1982

[54] APPARATUS AND METHOD FOR DRILLING INTO THE SIDEWALL OF A DRILL HOLE

[75] Inventors: Alfred E. Jageler; Robert A. Broding; Lauren G. Kilmer, all of Tulsa, Okla.

[73] Assignee: Standard Oil Company (Indiana), Chicago, Ill.

[21] Appl. No.: 51,485

[22] Filed: Jun. 25, 1979

[51] Int. Cl.[3] ..... E21B 49/06

[52] U.S. Cl. ..... 175/45; 175/58; 175/61; 175/107; 173/36

[58] Field of Search ..... 175/45, 61, 73–78; 175/107, 58; 137/15, 614.04; 173/36; 166/55.2

[56] References Cited

U.S. PATENT DOCUMENTS

| | | | |
|---|---|---|---|
| 1,850,403 | 3/1932 | Lee | 175/74 |
| 2,173,532 | 9/1939 | DeLong | 175/107 X |
| 2,324,682 | 7/1943 | DeLong | 175/107 X |
| 3,148,740 | 9/1964 | Cauchois | 175/78 |
| 3,544,957 | 2/1969 | Smetanin et al. | 175/45 X |
| 3,630,296 | 12/1971 | Bullard | 175/77 |
| 4,119,148 | 10/1978 | Deardorf | 166/55.2 |

FOREIGN PATENT DOCUMENTS

| | | | |
|---|---|---|---|
| 996408 | 6/1965 | United Kingdom | 137/614.04 |
| 138548 | 3/1960 | U.S.S.R. | 175/78 |
| 140006 | 3/1977 | U.S.S.R. | 175/77 |

*Primary Examiner*—Ernest R. Purser
*Attorney, Agent, or Firm*—John D. Gassett

[57] ABSTRACT

A method of core cutting and apparatus operable on a seven conductor wireline logging cable for drilling a hole in the sidewall of a drill hole which comprises an elongted housing with a hydraulically operated backup shoe mounted within the housing for wedging the housing at a selected location in the drill hole and a hydraulic motor with a drilling bit connected thereto for rotation by the hydraulic motor. Hydraulic means are mounted within the housing and are connected to the hydraulic motor for moving the bit into drilling engagement with the sidewall of the drill hole. In one embodiment, a core cutting bit is connected to the motor for obtaining a sample of a subterranean formation at the selected location.

41 Claims, 29 Drawing Figures

APPARATUS AND METHOD FOR DRILLING INTO THE SIDEWALL OF A DRILL HOLE

BRIEF SUMMARY OF THE INVENTION

A new apparatus has been developed for obtaining true samples of subterranean formations and recovering portions of their contained fluids. These samples are useful in evaluating the geological, mineralogical, and physical characteristics of formations of interest. This apparatus is contained within a suitable housing which can be lowered on a standard seven conductor wireline logging cable through a drill hole to a formation of interest as detected by a gamma ray logging device connected to the housing. The apparatus is suspended at the formation of interest, and by signal from a control panel, a hydraulic means is activated to wedge the apparatus within the drill hole. A hydraulic motor with a core cutting head attached thereto through a core retaining barrel is activated at the control panel for rotating the cutting head and by separate signal from the control panel, a hydraulic means is activated to move the cutting head into cutting engagement with the sidewall of the drill hole. Upon completion of cutting the core, the core retaining barrel and cutting head are deflected to break the core from the formation. The core retaining barrel containing the core is then retracted to within the housing, and the housing is removed from the drill hole. Separate hydraulic systems are provided for operating the hydraulic motor and for operating the hydraulic means. Electricity for operating the hydraulic systems is provided through six of the conductors of the wireline logging cable and the seventh conductor is used for control and monitoring.

DETAILED DESCRIPTION

Figure 1:
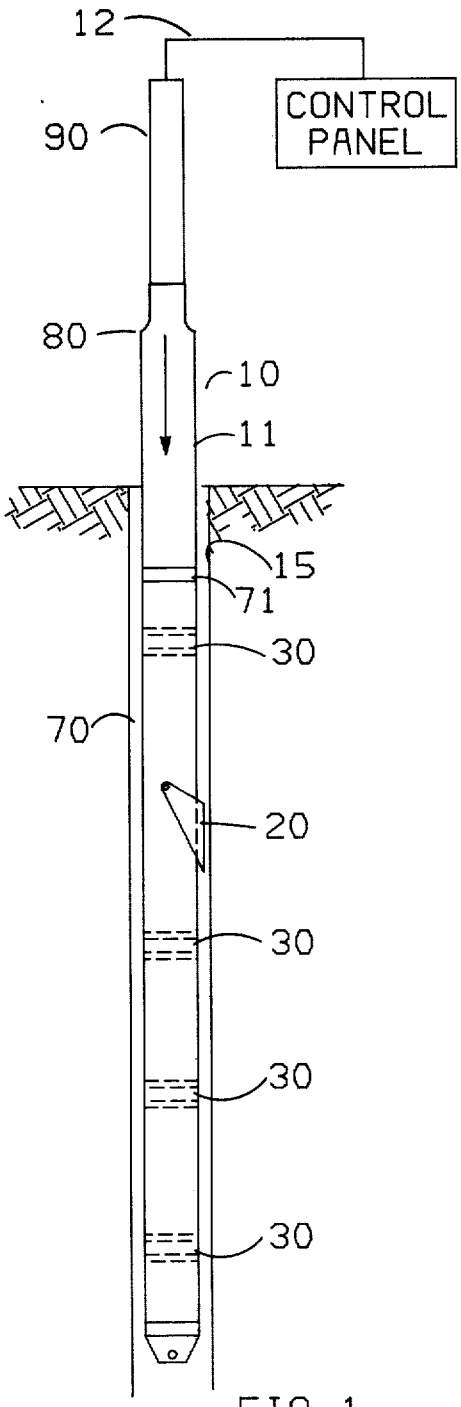
FIG. 1 is a schematic view depicting the lowering of the first embodiment of the apparatus of the present invention into a drill hole.

The method and apparatus of the present invention comprises a support member, a shoe means mounted to the support member for movement toward and away from the sidewall of a drill hole, a hydraulic motor means mounted to the support member for movement toward and away from the sidewall of a drill hole, and a drilling bit means connected to the rotor of the hydraulic motor means for drilling a hole. The apparatus is positioned at a selected location in a drill hole for drilling into the sidewall of the drill hole. At the selected location, the shoe means is activated for wedging the apparatus in the drill hole. This is followed by activating the hydraulic motor means for rotating the drilling bit and for drilling into the sidewall of the drill hole. The drilling bit is then retracted and the apparatus is removed from the drill hole.

The apparatus of the present invention can conveniently be enclosed within a housing means for protecting the elements of the apparatus. This housing means has an opening through which the shoe means can move for wedging it at a location in the drill hole and an opening through which the drilling means can move to drill into the sidewall of the drill hole.

The drilling bit means can be equipped for various assignments, such as drilling into the sidewall of a drill hole for producing an opening or for obtaining a sample. Appropriate drilling bit means would be selected for drilling directly into the subterranean formation forming the sidewall of the drill hole and for drilling through metal when the drill hole is lined with steel casing. A diamond impregnated bit is suitable for drilling into subterranean formation while a tungsten-carbide bit is suitable for drilling through casing and into the subterranean formation behind the casing.

The drilling bit means can be equipped with a core drilling bit and a core retaining barrel means for taking samples from the sidewall of the drill hole. The core drilling bit, such as a diamond impregnated bit, is connected through the core retaining barrel means to the rotor of the hydraulic motor for taking a sample from the sidewall of a drill hole and for retaining the sample.

The apparatus can also be equipped with a means for deflecting the core drilling bit at the completion of cutting a core in formation forming the sidewall of a drill hole. Deflection of the core drilling bit breaks the core from the sidewall. The means for deflecting the core drilling bit can be a guide track means through which a guide track engaging means connected to the hydraulic motor travels during the cutting of the core and which has a means at the completion of the cutting of the core for moving the motor at about right angles to the movement of the motor during the cutting of the core. With a groove as the guide track means and a pin as the guide track engaging means, the groove can be enlarged at the completion of the cutting of the core to provide for this deflection. The core barrel and core drilling bit are sized such that there will be less clearance of the core within the core barrel than of the core barrel within the hole drilled by the core drilling bit. The core is broken from the formation by deflecting or moving the rear of the core barrel at about right angles to the direction of the movement of the core drilling bit during the cutting of the core. This deflection applies pressure at the top of the core and breaks the core from the formation at the bit.

The drilling bit can be extended into drilling engagement with the sidewall of the drill hole and retracted by any convenient means such as by the use of hydraulic means for extending and retracting the bit or by the use of hydraulic means for extending the bit and spring means for retracting the bit. In one embodiment of this apparatus as described in this application, constant tension springs are used for retracting the bit and hydraulic cylinders are used for extending the bit. In the event of the loss of hydraulic power, the springs would retract the bit and the apparatus would be free for removal from the drill hole. In another embodiment of this apparatus as described in this application, a double acting hydraulic cylinder is used for extending and retracting the bit.

The apparatus of the present invention is conveniently operated with two hydraulic systems. A high volume system is used for the rotation of the hydraulic motor means and a low volume system is used for the operation of the hydraulic means used for the movement of the shoe means and the drilling bit means. The fluid flow for movement of the drilling bit means into drilling engagement with the sidewall of a drill hole is preferably controlled with a fluid flow restrictor valve that has an orifice through which fluid flows to move the drilling bit into the drilling engagement. The valve has an orifice restricting means such as a slender pointed rod with the pointed end positioned for movement toward and away from the orifice. Movement of the slender pointed rod is controlled by opposing spring and control fluid means engaging this slender pointed rod. In the embodiment described in this application, fluid pressure from the high volume system opposes a spring through a piston connected to the slender pointed rod. The spring and opposing control fluid means are arranged within a cylinder for moving the pointed end of the slender rod into engagement with the orifice when pressure increases in the high volume system. Pressure increases in the high volume system can be caused by the binding of the drilling bit during the cutting of the core caused by too much force being applied in the engagement of the bit with the sidewall. The engagement of the slender rod with the orifice reduces the volume of fluid for movement of the drilling bit into drilling engagement with the sidewall of the drill hole, thereby reducing the binding of the drilling bit.

Solenoid operated valves connected through rotary switch means to a control panel means are used for controlling the movement of hydraulic fluid through the apparatus. These valves control the extension and retraction of the shoe means, the selection of a hydraulic motor means in embodiments having a plurality of hydraulic motor means and the extension and retraction of the drilling bit means. In a first embodiment of this invention as described in this application, two rotary switch means are used for selecting and controlling the operations to be performed. In the first embodiment, solenoid operated valves for controlling the extension and retraction of the shoe means and for activating one out of a plurality of drilling bit means for rotation are connected to a first rotary switch. Solenoid operated valves for controlling the extension and retraction of the selected drilling bit means are connected to a second rotary switch. In a second embodiment, three rotary switches are used for selecting and controlling the operations to be performed. In this second embodiment, solenoid operated valves for activating one out of a plurality of drilling bit means are connected to a first rotary switch. Also connected to this first rotary switch is means for selecting the operation of the second or the third rotary switch means. Solenoid operated valves for controlling the extension and retraction of the shoe means are connected to the second rotary switch and solenoid operated valves for controlling the extension of a selected drilling bit means is connected to the third rotary switch. In a third embodiment, two rotary switches are used for selecting and controlling operations to be performed. In this embodiment, solenoid operated valves for extending and retracting the shoe means are connected to the first rotary switch and solenoid operated valves for extending and retracting a single drilling bit means are connected to the second rotary switch.

The operations of the apparatus are conveniently monitored by the use of position transducers, pressure transducers, and resistors and the transmission of their output to the control panel means through a dedicated conductor of a multiconductor wireline logging cable. The position transducers are connected to the shoe means and to the hydraulic motor means for monitoring their movement toward and away from the sidewall of a drill hole, a pressure transducer is connected to the high volume hydraulic system for monitoring the pressure being applied through the hydraulic motor to the rotation of the bit, and resistor means are connected to the rotary switch means to monitor the selection of switch positions.

The outputs of the position and pressure transducers are converted to frequency and transmitted as frequency through the dedicated conductor to the control means where their outputs are separated and monitored. The outputs from separate transducers are converted to frequencies within a selected range such that the frequency range corresponding to the output from the separate transducers are separated at the control panel means and converted to separate monitoring signals.

The output of the resistor means is transmitted directly through the dedicated conductor to the control means and is monitored on a resistance measuring means such as an ohmmeter. A positive and negative reading ohmmeter can be used in combination with diodes in the circuit for monitoring separate resistors with positive and negative voltage being transmitted over the dedicated conductor.

The operation of the rotary switches and the transmission of the output from the position and pressure transducers, and resistors can all be made on one dedicated conductor of a multiconductor wireline logging cable which supplies power through separate conductors for operation of the hydraulic systems. The positive and negative direct current pulses for rotating the rotary switches are separately transmitted through the dedicated conductor. The output from the position and pressure transducers are converted to frequency and transmitted over the dedicated conductor in conjunction with the transmission of the output from the resistor. These outputs can be transmitted over the dedicated conductor at all times except during the transmission of pulses for rotation of the rotary switches.

One embodiment of the sidewall coring apparatus of the present invention is illustrated with respect to FIGS. 1 through 16. In FIG. 1, the sidewall coring apparatus 10 is illustrated as being lowered into drill hole 15 by means of a cable 12 connecting the upper end of the coring apparatus 10 with a control panel means. A housing means 11 in the form of a steel cylinder is utilized to contain all of the elements of the coring apparatus 10. The lower portion of the housing 11 primarily contains the mechanical elements and is designated as the mechanical section 70. The middle portion primarily contains hydraulic elements and is designated as the hydraulic section 80. The upper portion primarily contains electrical elements and is designated as the electrical section 90.

The housing means 11 of this embodiment has an overall length of about 25 feet and the apparatus has a weight of about 600 pounds, exclusive of the cable head which connects the cable 12 to the upper portion of the housing 11. The mechanical section 70 has a diameter of about 5 inches, and the electrical section has a diameter of about 3¾ inches. The lower portion of the hydraulic section has a diameter of about 5 inches, while the upper portion has a diameter of about 4½ inches. A reducing sub is used to connect the hydraulic and electrical sections and has a diameter of about 4½ inches at its lower end and a diameter of about 3-13/16 inches at its upper end. The collar 71, which connects the mechanical section to the hydraulic section, has a diameter of about 5¾ inches.

Figure 2:
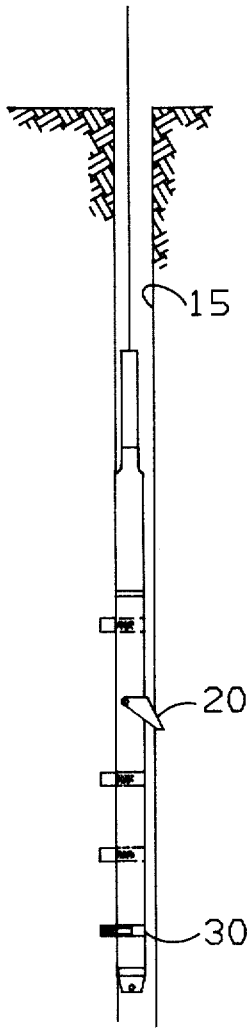
FIG. 2 is a schematic view depicting the first embodiment anchored in a drill hole and cutting a core from the side wall of a drill hole.
Figure 3:
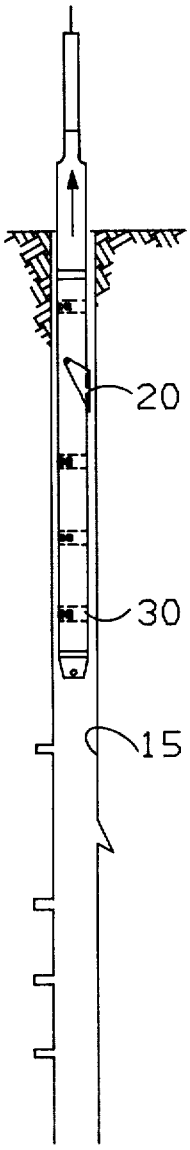
FIG. 3 is a schematic view depicting the removal of the first embodiment from a drill hole.

In this embodiment, the principal elements of the mechanical section are four hydraulic coring means 30 and a hydraulically operated backup shoe means 20. By signal from the control panel means, the backup shoe 20 is moved into engagement with the wall of drill hole 15 for forcing the housing 11 into engagement with the wall on the opposite side of the drill hole 15 from the engagement of the backup shoe 20. A core cutting means 30 is then activated at the control panel means and cuts a core from the wall of the drill hole. FIG. 2 depicts the backup shoe 20 as being engaged with the wall of drill hole 15 and the lower core cutting means 30 in the process of cutting a core from the wall of drill hole 15. It is depicted in FIG. 2 that cores have already been cut by the upper three core cutting means, and the cores are depicted as being retained within the upper three core cutting means. FIG. 3 depicts the backup shoe means 20 in a retracted position, and the sidewall coring apparatus 10 as being removed from drill hole 15.

Figure 4:
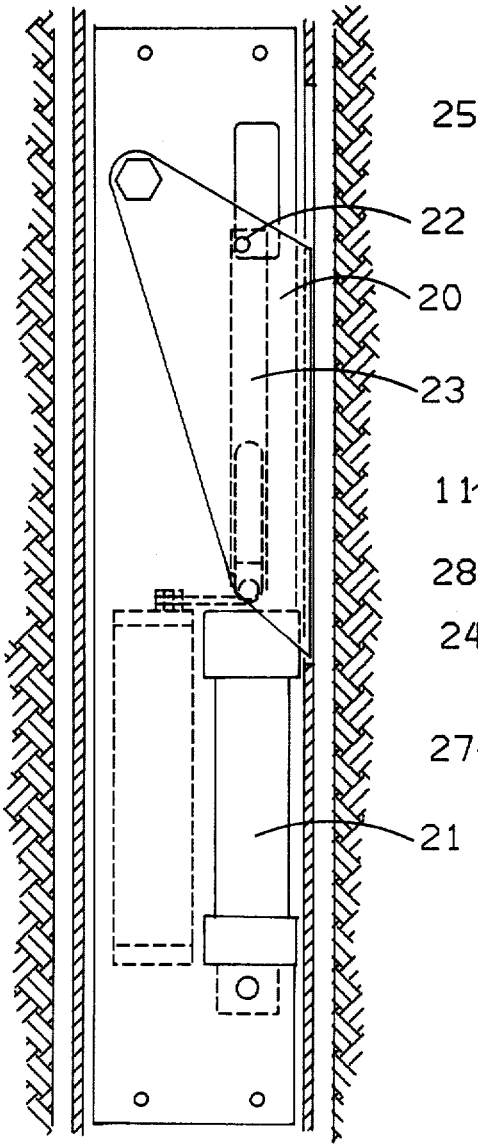
FIG. 4 is a schematic view of the backup shoe of the first embodiment.
Figure 5:
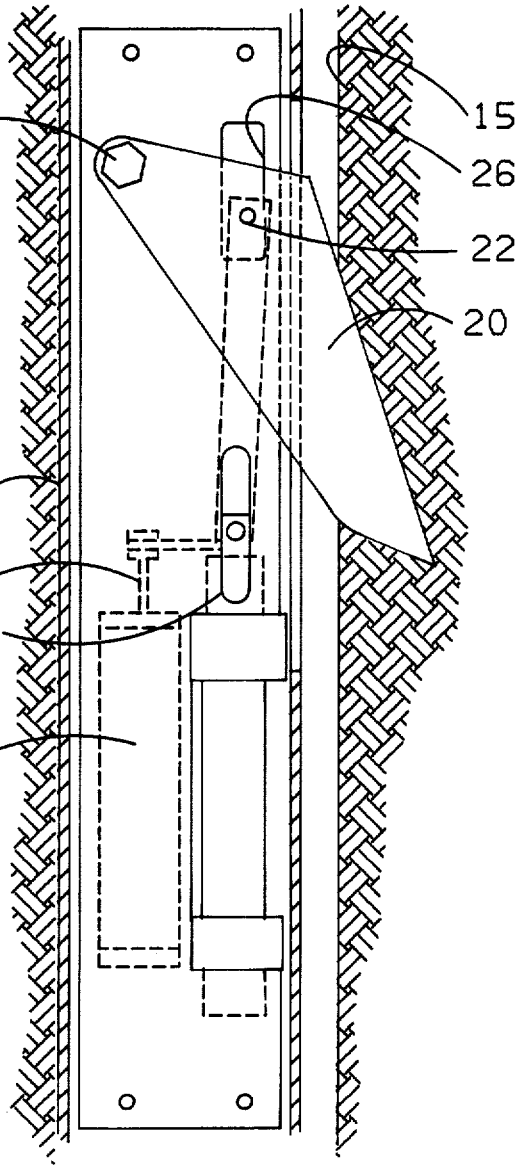
FIG. 5 is a schematic view depicting the backup shoe of FIG. 4 anchoring the first embodiment in a drill hole.

FIGS. 4 and 5 depict the backup shoe means 20 in detail. As illustrated in FIG. 4, the shoe is operated by a double acting hydraulic cylinder 21 connected to the backup shoe 20 at guide pin 22 through connecting arm 23. On signal from the control panel means, the ram 24 of hydraulic cylinder 21 is extended, as illustrated in FIG. 5, to pivot the backup shoe about pivot pin 25 and into engagement with the side wall of the drill hole 15. On extension of the ram 24, the guide pin 22 moves through the guide slot 26. Movement of the shoe is monitored by a position transducer 27 coupled to the ram 24 through an arm 28. Engagement of the shoe with the drill hole forces the housing 11 against the opposite side of the drill hole. By releasing the tension on the cable, the weight of the side wall coring apparatus 10 will cause the shoe 20 to dig into the wall and further anchor or wedge the housing 11 within drill hole 15.

Figure 6:
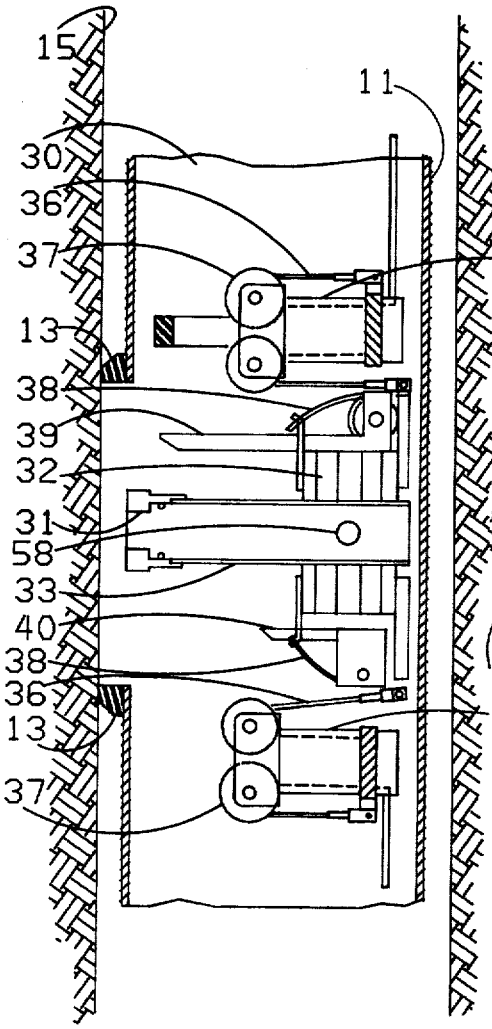
FIG. 6 is a schematic view depicting the hydraulic core cutting means of the first embodiment.
Figure 7:
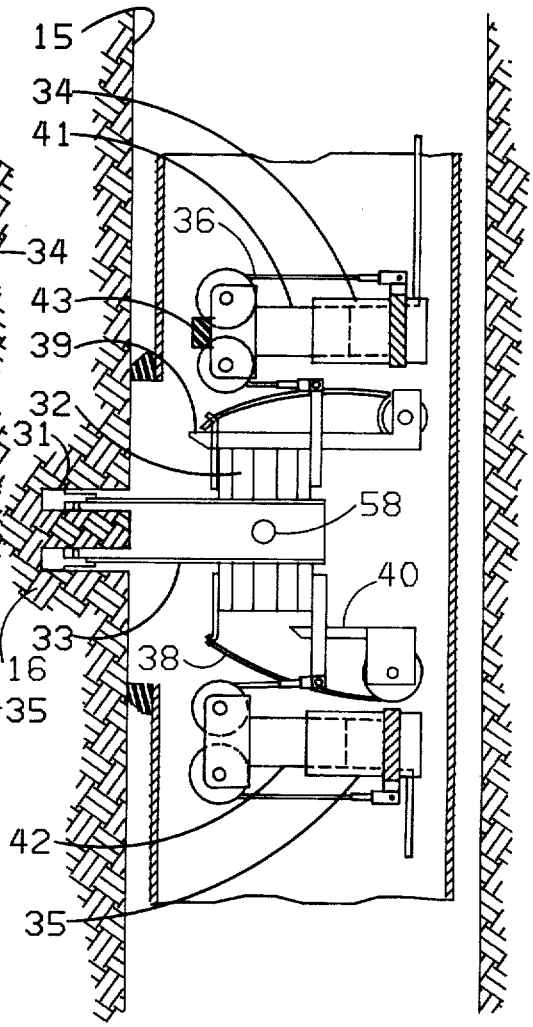
FIG. 7 is a schematic view depicting the core cutting means of FIG. 6 in the process of cutting a core.

FIGS. 6–9 depict the operation of the hydraulic core cutting means 30. As illustrated in FIG. 6, a core cutting head means 31 is connected to hydraulic motor 32 for rotation about the longitudinal axis of a core retaining barrel 33. The hydraulic motor 32 is connected to single acting hydraulic cylinders 34 and 35 for moving the core cutting head 31 through an opening in housing 11 and into cutting engagement with the wall of drill hole 15. The hydraulic motor 32 is connected to the hydraulic cylinders 34 and 35 through cables 36 which extend across rollers 37. On extension of hydraulic rams 41 and 42 of hydraulic cylinders 34 and 35 respectively, as shown in FIG. 7, force is transmitted through cables 36 to urge the cutting head 31 into engagement with the wall of the drill hole. The core cutting head is maintained in a normally retracted position by the action of flat wound constant tension springs 38 and is guided during the cutting of a core by guide members 39 and 40 and guide pin 58. The guide pins 58 travel through guide grooves 59 in support members 46 as illustrated in FIG. 10. The housing means 11 of the sidewall coring apparatus 10 is equipped with a standoff 13 which has a height of about ⅜ inch and extends around the opening in the housing through which the cutting head moves. The standoff provides for minimum contact between the coring apparatus 10 and the side wall of the drill hole, thereby reducing the possibility of the coring apparatus becoming stuck against the side wall of the drill hole due to differential pressure between the formation and the interior of the drill hole. Collar 71, as shown in FIG. 1, has a larger diameter than the remainder of the coring apparatus and further reduces the possibility of the apparatus becoming stuck.

Figure 8:
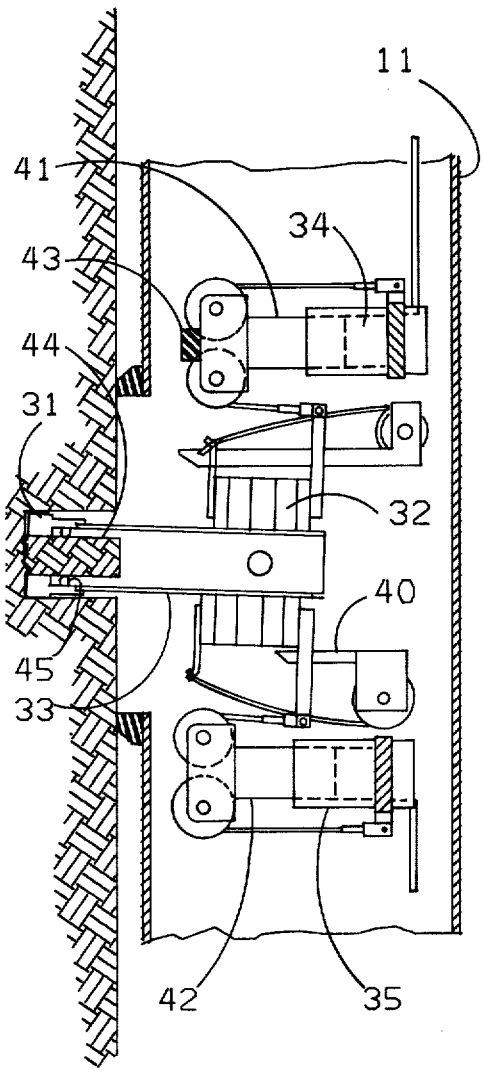
FIG. 8 is a schematic view depicting the core cutting means of FIG. 6 in the process of breaking a core from a formation.
Figure 9:
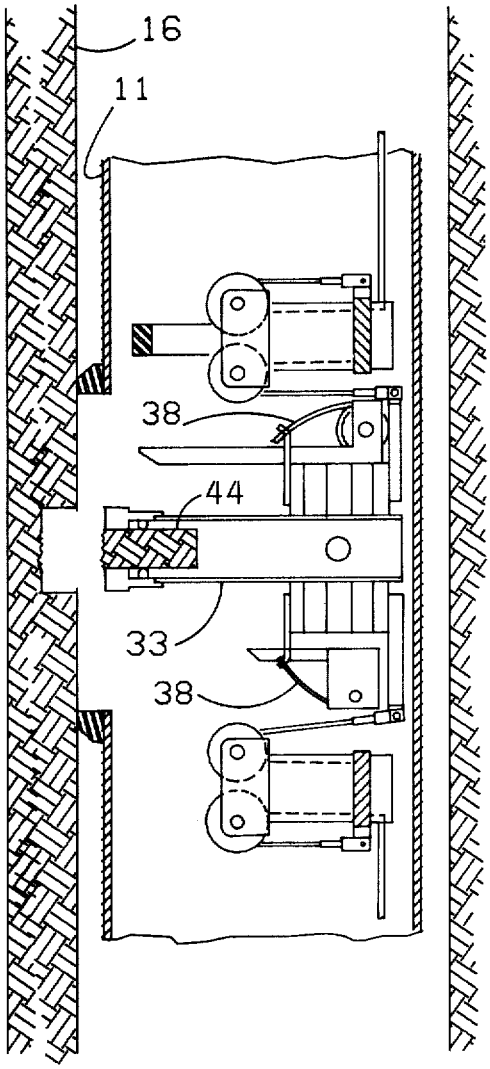
FIG. 9 is a schematic view depicting the core cutting means of FIG. 6 with a retained core.
Figure 10:
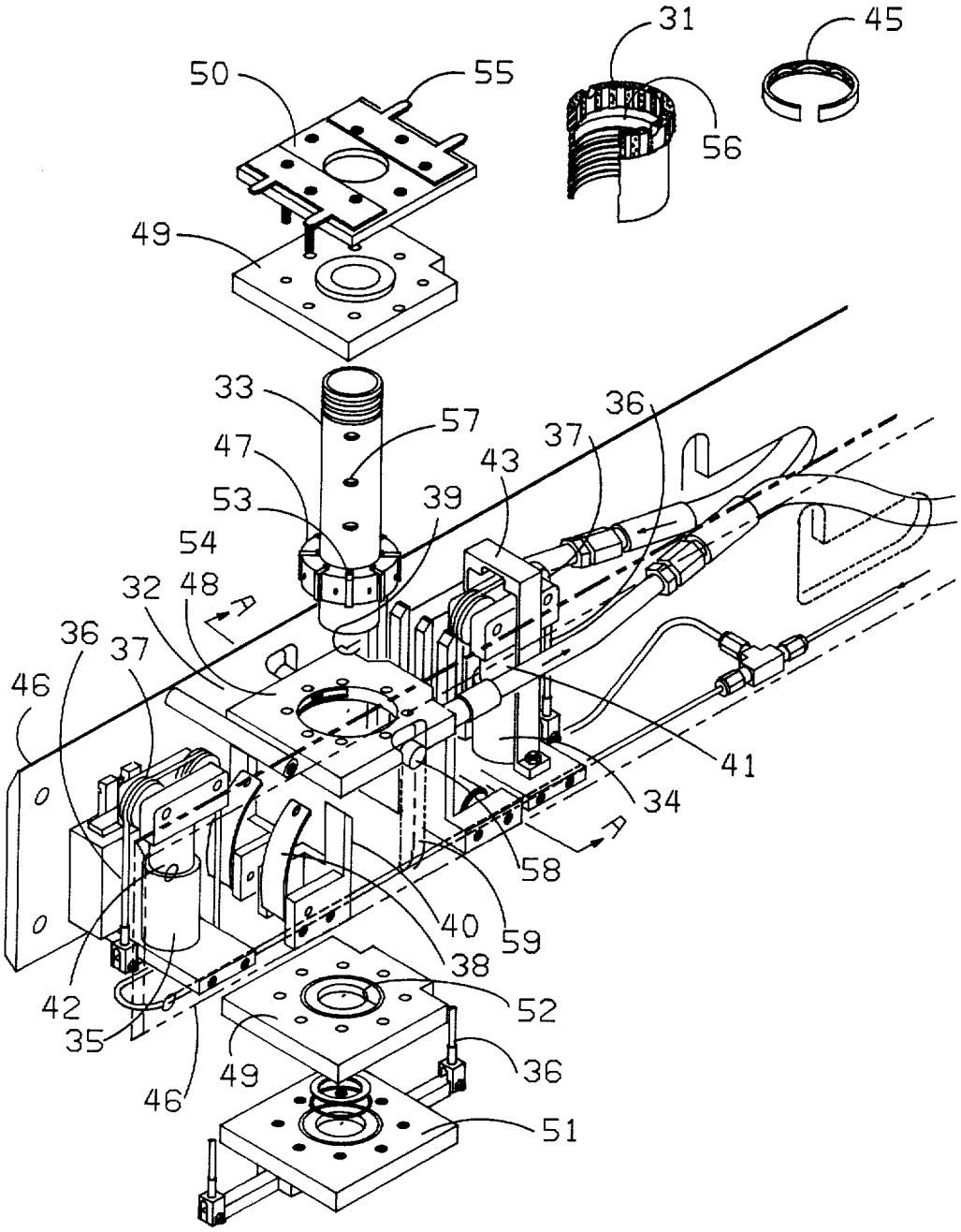
FIG. 10 is an isometric view depicting the core cutting means of the first embodiment.

The operation of the hydraulic core cutting means 30 is depicted during the cutting of a core from a subterranean formation 16 in FIG. 7, during the breaking of the core 44 from the formation 16 in FIG. 8 and retaining the core 44 within the housing 11 in FIG. 9. The hydraulic motor 32 is activated at the control panel means to rotate the core cutting head 31 about the longitudinal axis of the core retaining barrel 33. By separate signal from the control panel, the hydraulic cylinders 34 and 35 are activated for movement of the hydraulic motor 32 along guide 39 and thereby to urge the rotating head 31 into engagement with the wall of drill hole 15. The core cutting head generally utilizes diamonds as cutting surfaces.

It is shown in FIG. 7 that the ram 41 of hydraulic cylinder 34 is extended into engagement with a stop 43. Additional hydraulic pressure applied to hydraulic cylinders 34 and 35, as illustrated in FIG. 8, causes ram 42 of hydraulic cylinder 35 to further extend for deflection of the core retaining barrel means 33 within the hole drilled by the core cutting head 31. It is shown in FIG. 8 that this deflection causes the movement of the hydraulic motor 32 toward guide 40. The formation 16 within core retaining barrel 33 is thereby separated as a core 44 from the remainder of the formation 16. The core barrel 33 and core cutting head 31 are sized such that there is less clearance of the core within the core barrel 33 than the clearance of the core barrel within the hole drilled by the core cutting head 31. Core cutting head 31 is also equipped with a core retaining ring 45 to maintain the core within the core barrel. Hydraulic pressure on cylinders 34 and 35 is then released, as illustrated in FIG. 9, and the spring means 38 moves hydraulic motor 32 to a position within the housing 11 of the side wall coring apparatus.

Figure 11:
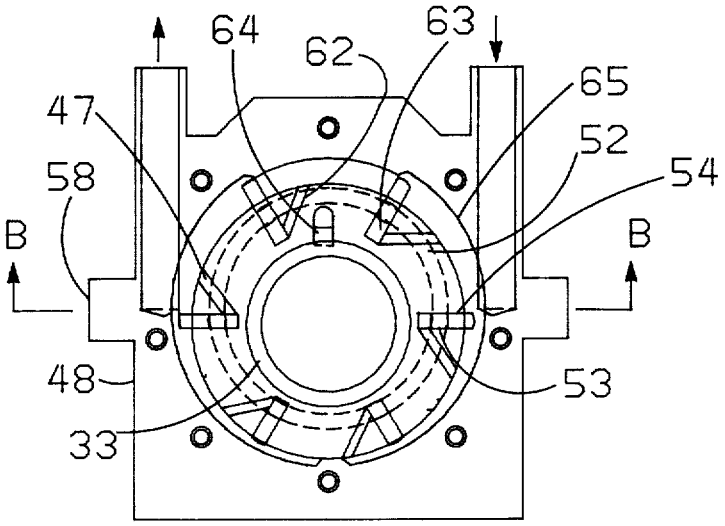
FIG. 11 is a cross section of the hydraulic motor of the hydraulic core cutting means taken through the rotor of the hydraulic motor.
Figure 12:
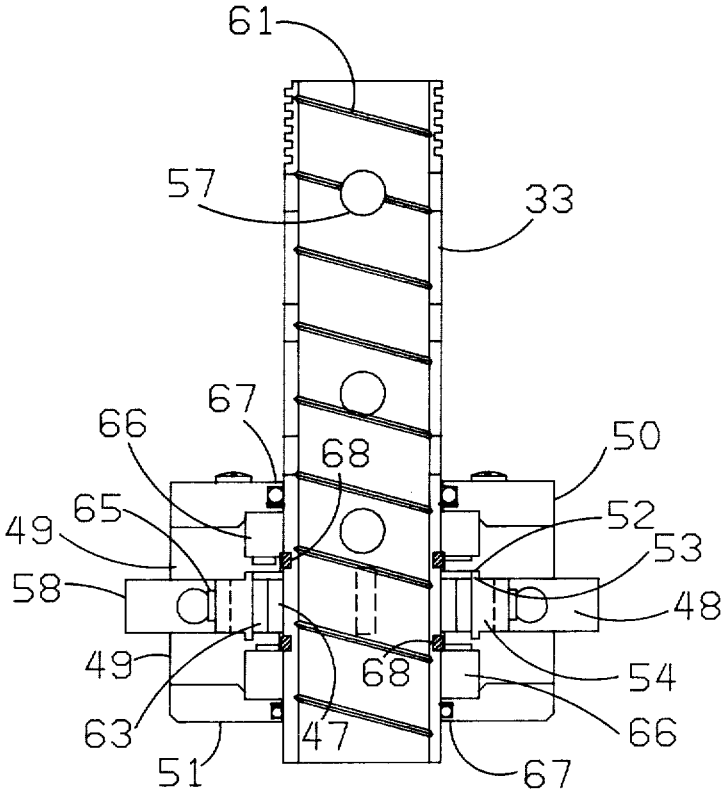
FIG. 12 is a cross section of the hydraulic motor of the hydraulic core cutting means taken through the core retaining barrel at the fluid inlet and exhaust ports.

Details of the hydraulic core cutting means 30 are illustrated in FIGS. 10, 11, and 12. As shown in FIG. 10, single acting hydraulic cylinders 34 and 35 which activate rams 41 and 42, cables 36 and rollers 37 to move the core cutting head 31 into engagement with the side wall of a drill hole are connected to support structures 46. This isometric drawing of the hydraulic motor 32 shows that the core barrel 33 extends through and is an integral part of the motor 32, with rotor 47 being securely attached to the core barrel 33 for operation within the motor body 48. This is also shown in FIGS. 11 and 12. The motor 32 is sealed by bearing plates 49 and pressure plates 50 and 51. The bearing plates 49 are equipped with guide grooves 52 in which the guide arms 53 of the vanes 54 travel to provide positive control of the movements of vanes 54 within the motor body 48. This provides a positive fluid seal within the hydraulic motor 32.

The single acting hydraulic cylinders 34 and 35 are connected to the hydraulic motor 32 by cables 36 at pressure plate 51. The four flat wound, constant tension springs 38 which maintain the coring head 31 in a normally retracted position are connected to the hydraulic motor 32 at arms 55 which extend from pressure plate 50.

The core cutting head 31 is threaded for being threadably connected to the core retaining barrel 33 and has a suitable groove 56 for receiving a snap-in core retaining ring 45. The core retaining ring 45 is fabricated of spring steel and is serrated at its core contacting edge such that it will grip a core 44 entering the core barrel 33 and thereby prevent loss or destruction of the core. The core barrel 33 is also equipped with vents 57 which permit fluid and particles to move freely around the core cutting head 31. A spiral groove 61, as shown in FIG. 12, is also cut in the interior surface of the core barrel to further provide for the movement of fluid and particles within the core barrel 33.

In addition to the guides 39 and 40, guide pins 58 are connected to the body 48 of hydraulic motor 32 and move within guide slots 59 of support 46. The guide groove provides a guide track means to function in cooperation with the guide pins as guide track engaging means for controlling the path of the core cutting means during the cutting of a core. The upper portion of the guide slots 59 are expanded to permit the deflection of the hydraulic motor 32 from the guide members 39 toward the guide members 40 when the stop 43 prevents the further movement of ram 41 of hydraulic cylinder 34. As previously described, the deflection of the hydraulic motor 32 and core barrel 33 causes a core to be broken from a formation. The cooperation of guide members 39 and 40 with the movement of guide pins 58 through guide slots 59 provides positive control of the orientation of the core cutting head 31 during the cutting of a core 44.

A cross section of hydraulic motor 32 through the center of rotor 47 is shown in FIG. 11. It is shown that the fluid enters the hydraulic motor 32 at the right and exhausts at the left to provide a counterclockwise rotation to rotor 47 and to core barrel 33 connected thereto by key 64. The guide grooves 52 in bearing plates 49 are shown by phantom lines in FIG. 11 to illustrate the connection between the guide grooves 52 as guide track means and guide arms 53 as guide track engaging means for providing positive control of the movement of the vanes 54 within the motor body 48. With the core barrel extending through the rotor, vanes on opposite sides of the rotor cannot be connected for maintaining positive engagement of the vanes with the periphery of the rotor cavity during the rotation of the rotor. It is also shown that a conduit means 62 is provided in the rotor 47 for the communication of fluid between the portion of vanes 54 contacting the periphery of the rotor cavity and the portion of the vanes within opening 63. Conduit 62 provides communication for fluid between the portion of vanes 54 contacting the periphery of the rotor cavity and a location in the opening 63 adjacent to and preferably below the lowest level which the vanes 54 move in the rotor during the rotation thereof. The guide pins 58 on motor body 48 are also shown in FIG. 11.

This conduit 62 in the rotor provides means for pressure equalization between the opening in the rotor and the portion of the rotor cavity surrounding the rotor. As the vanes move outwardly in the opening, pressure equalization prevents vaporization of fluid in the openings below the vanes. As the vanes move into the openings, fluid within the openings bleeds through the conduit and into the portion of the rotor cavity surrounding the rotor.

The cross section of hydraulic motor 32 through the center of core retaining barrel 33 is shown in FIG. 12. It is shown that core barrel 33 is connected to rotor 47 at key 64, that core barrel 33 rotates within hydraulic motor 32 on bearing 66 and that thrust rings 68 are provided for maintaining the core barrel 33 within motor 32. Seals 67 such as combination O-ring and carbon seals are provided for maintaining fluid within the motor 32. Additionally, the guide grooves 52 in bearing plates 49 are shown in FIG. 12 along with guide arms 53 connected to vanes 54 for providing positive control of the movement of the vanes 54.

This cross section is taken through the fluid inlet and exhaust ports of the hydraulic motor and shows the position of the vanes 54 in openings 63 at that location. Shown by phantom lines in FIG. 12 is the height of the rotor 47 with respect to the position of the vanes 54 at that location. Recess 65, as shown in FIGS. 11 and 12, is machined in the periphery of the rotor cavity of motor 32 to increase the exposure time of the chambers formed between vanes 54 to the fluid at the fluid inlet and exhaust ports. Also shown in FIG. 12 is the spiral groove 61 in the interior surface of the core barrel 33 and the openings 57 in the core barrel which provide for the movement of fluid and particles within the core barrel 33.

Figure 13:
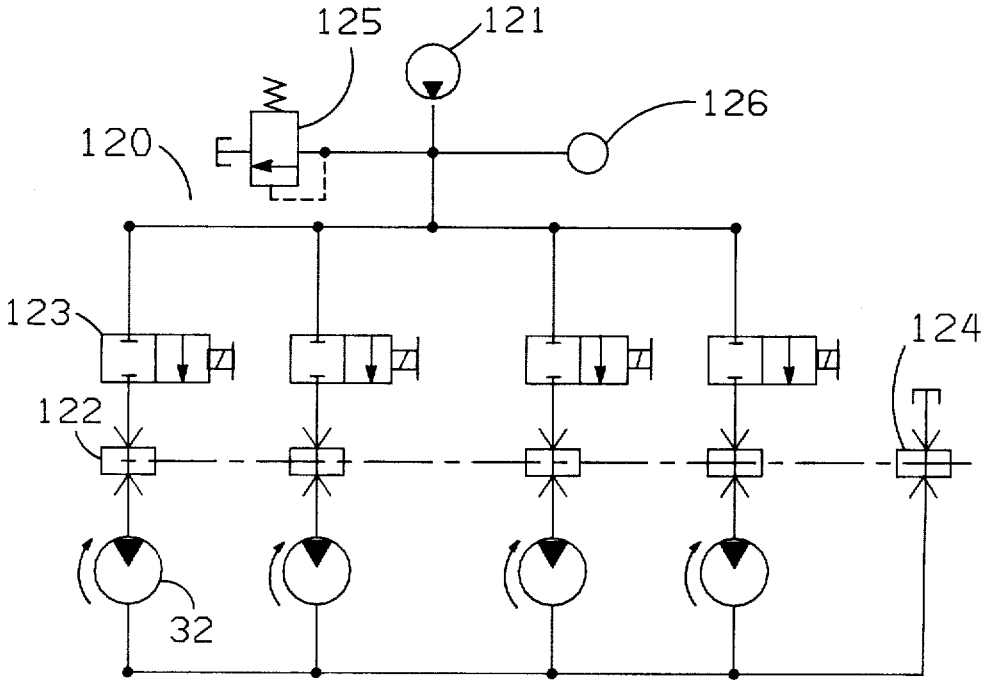
FIG. 13 is a schematic representation of the hydraulic system of the first embodiment which operates the hydraulic motors of the core cutting means.
Figure 14:
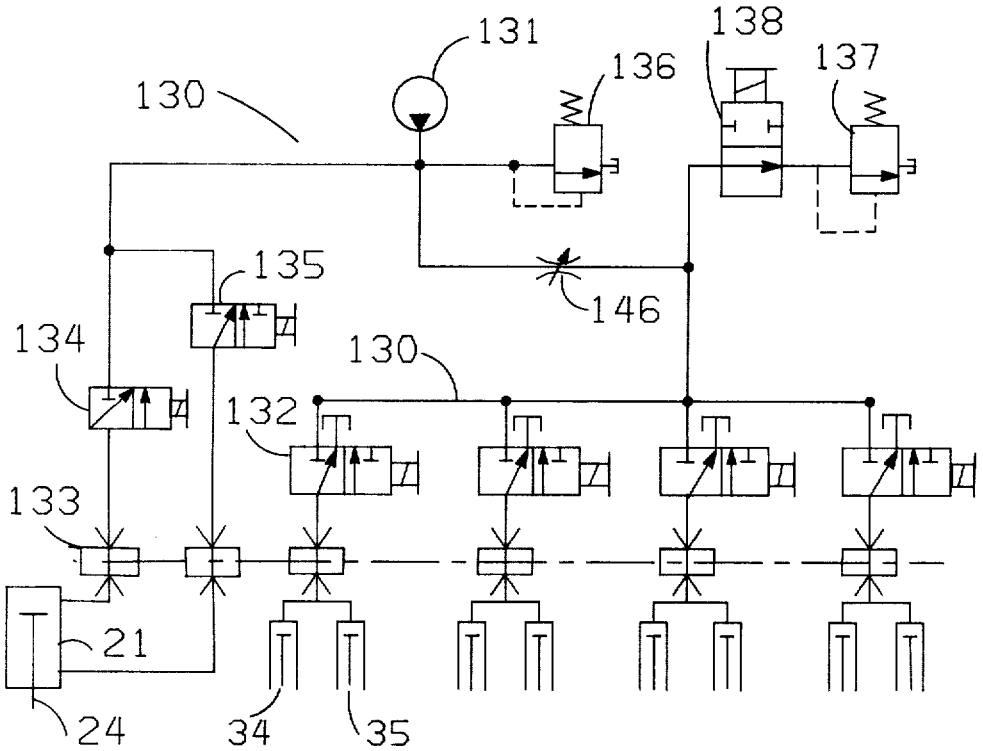
FIG. 14 is a schematic representation of the hydraulic system of the first embodiment which operates the hydraulic cylinders of the backup shoe and core cutting means.

The backup shoe means 20 and core cutting means 30 are operated by hydraulic pressure supplied by the two hydraulic systems shown diagrammatically in FIGS. 13 and 14. The high volume hydraulic system 120, as shown in FIG. 13, provides the hydraulic fluid for operating the hydraulic motors 32 and is operated by a 7 gallon per minute hydraulic pump 121 driven by a one horsepower, 440 volt, alternating current, three-phase electric motor. This high volume hydraulic pump 121 is located in the hydraulic section 80 of the coring apparatus 10 and is connected to the hydraulic motors 32 through bulkhead connectors 122 and solenoid operated, two-way, normally closed valves 123. Hydraulic system 120 is also provided with a pressure relief valve 125 and a pressure transducer 126.

By signal from the control panel means, a selected valve 123 is opened and hydraulic fluid in system 120 flows through the selected valve, bulkhead connector 122, and hydraulic motor 32 to cause rotation of the cutting head 31 connected to the motor. The exhaust hydraulic fluid from the motor 32 flows into a hydraulic fluid reservoir in the hydraulic section 80 through bulkhead connector 124.

The low volume hydraulic system 130, as shown in FIG. 14, provides the hydraulic fluid for extension and retraction of the backup shoe 20 and for extending the cutting means 30. This hydraulic system is operated by a low volume hydraulic pump 131 driven by a 120 volt, alternating current, single-phase electric motor. This hydraulic pump 131 is located in the hydraulic section 80 of the coring apparatus 10 and is connected to the extension cylinders 34 and 35 of the cutting means 30 through solenoid operated, three-way, normally closed valves 132 and through bulkhead connectors 133. The hydraulic pump 131 is connected to the hydraulic cylinder 21 of the backup shoe 20 through solenoid operated, three-way, normally closed valves 134 and 135 and through bulkhead connectors 133. Hydraulic system 130 is also provided with a high pressure relief valve 136, a low pressure relief valve 137, a variable flow control valve 146 and a solenoid operated, two-way, normally open valve 138.

By signal from the control panel means, a selected valve 132 is opened and hydraulic fluid flows through the selected valve for causing the selected core cutting means 30 to move into contact with the side wall of a drill hole. While cutting a core, hydraulic system 130 is operated with valve 138 in its normally open position at selected pressures below the pressures which would stall a core cutting means 30, about 10 to 20 psi depending upon the type of rock being cored.

The flow control valve 146 partially isolates the low pressure portion of the hydraulic system 130 at the core cutting means from the high pressure portion at the backup shoe means. In order to break the core from the formation being cored, the valve 138 is closed for applying the full pressure of hydraulic system 130, about 450 psi, to cylinders 34 and 35.

By separate signals from the control panel means, the valve 134 is opened for extending the backup shoe 20 and valve 135 is opened for retracting the backup shoe 20. By connecting the double acting hydraulic cylinder 21 to valves 134 and 135, as depicted in FIG. 12, all of the hydraulic pressure generated within the hydraulic system 130 will cause extension or retraction of the ram 24 of cylinder 21 and thereby the extension or retraction of the backup shoe 20. Valve 134 is connected such that it remains open during the core cutting operation.

Figure 15A:
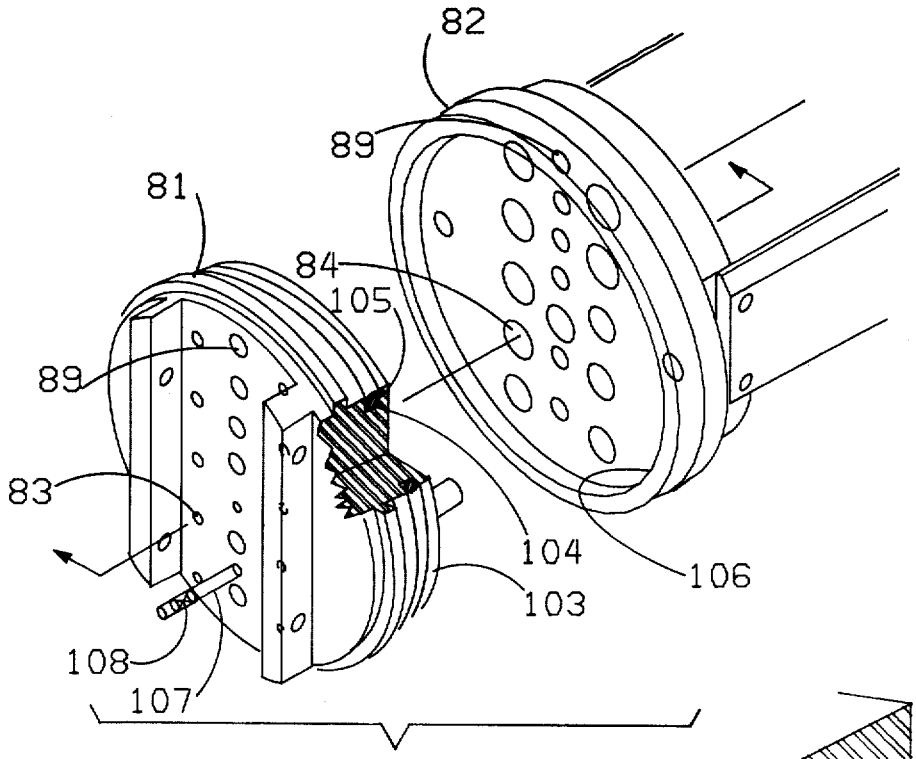
FIG. 15A is a schematic view of the bulkhead and hydraulic connectors of the first embodiment.
Figure 15B:
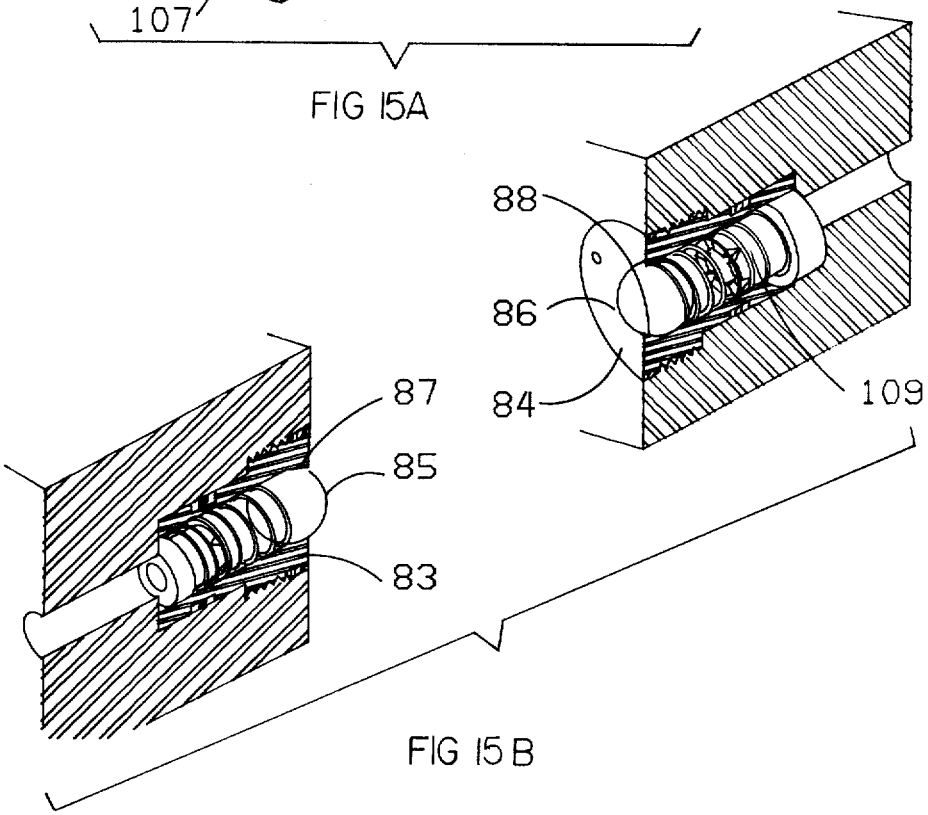
FIG. 15B illustates in detail the connections of the spring-loaded ball valves of FIG. 15A.
Figure 16:
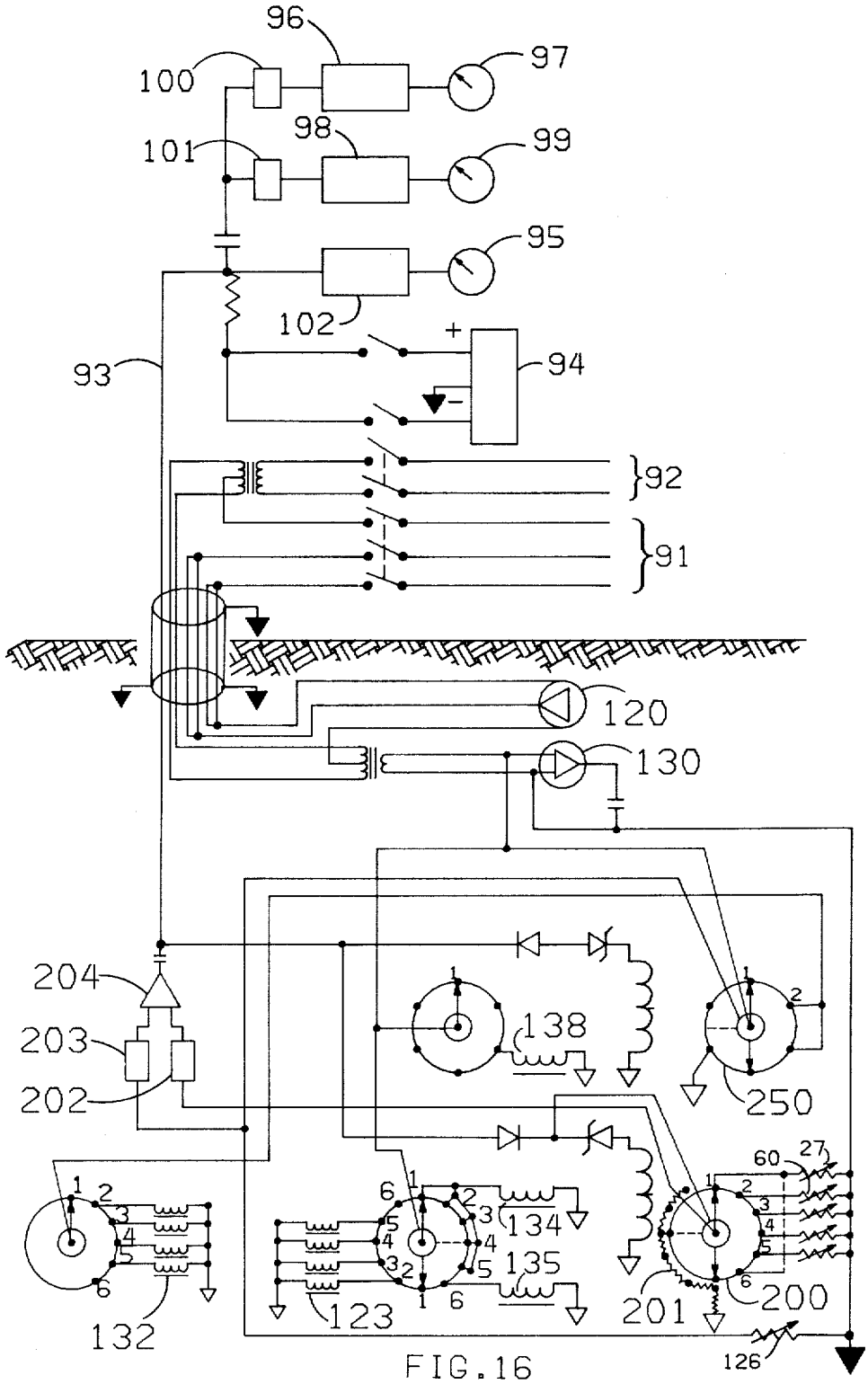
FIG. 16 is a schematic representation of the electrical operation and control systems of the first embodiment.

The hydraulic fluid lines are fitted, as shown in FIG. 15A and FIG. 15B, at the bulkheads 81 and 82 between the mechanical section 70 and the hydraulic section 80 with bulkhead connectors which comprise spring loaded ball valves 83 and 84 and with commercially available electrical feed through connectors 89. Ball valve 83 is in the mechanical section 70 while ball valve 84 is in the hydraulic section 80. These ball valves are normally closed when the hydraulic and mechanical sections are separated.

The spring tension on these ball valves is best understood by reference to FIGS. 13 and 14. In FIG. 13, it is seen that the hydraulic fluid of high volume hydraulic system 120 flows from the hydraulic section 80 through bulkhead connectors 122 into the mechanical section 70. Springs in the hydraulic section 80 portion of the bulkhead connectors 122 are selected to exert less force on the ball 86 than the spring in the mechanical section 70 portion of the bulkhead connectors 122 exert on ball 85. The springs are selected such that ball valve 83 of the mechanical section 70 will remain at least partially closed and the ball valve 84 of the hydraulic section 80 will remain open on mating of the bulkheads 81 and 82. On mating of the bulkheads, the ball 85 of connector 122 will force ball 86 of connector 122 away from seat 88. The mechanical section of connector 122 will remain at least partially closed until hydraulic pressure is developed in the high volume hydraulic system 120 to thereby completely move ball 85 away from seat 87 and maintain the valves 83 and 84 in an open position during the operation of the hydraulic core cutting means 30. This permits the use of spring loaded ball valves in the high volume hydraulic system. As a safety precaution, serrated stops 109 are provided in valves 83 and 84 to prevent the valves from completely closing during the flow of fluids therethrough.

To exhaust the hydraulic fluid from the mechanical section 70 to the hydraulic section 80 in hydraulic system 120, the springs in the connector 124 are selected such that the ball valve 83 of the mechanical section 70 will remain open and the ball valve 84 of the hydraulic section 80 will remain at least partially closed on the mating of the bulkheads 81 and 82. By development of hydraulic pressure within hydraulic system 120, the valves 83 and 84 will be in open positions during the operation of the core cutting means 30 such that the hydraulic fluid will exhaust into the hydraulic reservoir.

In the operation of the low volume hydraulic system 130, the hydraulic fluid both applies pressure through hydraulic cylinders 21, 34 and 35 and exhaust through ball valves 83 and 84 of connectors 133. Therefore, the springs of ball valves 83 and 84 in hydraulic system 130 are selected such that both valve 83 and 84 will be opened on the mating of bulkheads 81 and 82.

It has been found that the bulkheads 81 and 82 need to be mated under conditions such that there is a metal-to-metal mating of ball valves 83 and 84 and such that fluids from a drill hole are excluded from the ball valve mating surfaces. On mating of the bulkheads, individual O-rings around each ball valve and electrical connector prevent communication of fluid such as between the ball valves and between the ball valves and the electrical connectors. The fluids from the drill hole are excluded by providing an O-ring seal between bulkheads 81 and 82. The sealing surface 103 of bulkhead 81 has an O-ring receiving groove 104 and an O-ring 105. The O-ring 105 mates with the skirt 106 of bulkhead 82 to exclude bore hole fluids from the mating surfaces of the ball valves. To assure a metal-to-metal mating of the valves 83 and 84, bulkhead 81 has a bleed conduit 107 through which fluid between the bulkheads 81 and 82 bleeds during the mating of these bulkheads. On the mating of these bulkheads, it is preferred to draw the bulkheads together, such as with the collar 71 shown in FIG. 1, in such a manner that liquid leaks from valves 83 and 84 and bleeds through conduit 107. After the bulkheads are mated, valve 108 on conduit 107 is closed.

The sidewall coring apparatus 10 of this embodiment is operated on a standard seven conductor wireline logging cable. The control panel means is supplied by a 220 volt, alternating current, three-phase generator which inputs power to a transformer bank where voltage is stepped up to about 1000 volts for transmission down standard wireline logging cables. The three phases required to operate the 440 volt, alternating current, three-phase electric motor of the high volume hydraulic system 120 are conducted down three sets of paired conductors, collectively designated by the numeral 91 in FIG 16, of the seven conductor wireline logging cable. The single phase required to operate the 120 volt, alternating current, one-phase electric motor of the low volume hydraulic system 130 is supplied by a phantom circuit 92 across one of the sets of paired conductors 91 required to operate the three-phase electric motor of the high volume hydraulic system 120.

The seventh conductor 93 of the seven conductor wireline logging cable is used for monitoring and control operations. The control operations are effected by two rotary switches 200 and 250. Rotary switch 200 is a six position switch which is connected within the sidewall coring apparatus. It is shown that solenoid operated valve 134 is connected to rotary switch 200 for extending the backup shoe 20 at switch position 1, for maintaining the backup shoe in the extended position at positions 2 through 5, and that valve 135 is connected for retracting the backup shoe at position 6. At switch positions 2 through 5, a selected valve 123 is opened for causing rotation of the selected core cutting bit and a selected valve 132 is activated for extension of the selected cutting means 30. A positive voltage pulse transmitted over the seventh conductor 93 from direct current power generator 94 at the control panel causes the rotary switch 200 to advance one position, such as from a position 1 to position 2.

Rotary switch 250 is a three-position switch which is connected within the sidewall coring apparatus 10. It is shown that a selected valve 132 is connected to rotary switch 250 for extending the selected core cutting means at position 2 and for maintaining the core cutting bit in an extended position while closing valve 138 for deflecting the core cutting barrel at position 3. At switch position 1, the selected valve 132 will return to its normally closed position and valve 138 will return to its normally open position. A negative pulse voltage transmitted over the seventh conductor 93 from direct current generator 94 causes the rotary switch 250 to advance one position such as from position 1 to position 2.

Rotary switch 200 is connected to a resistor string 201, which is in turn connected through the seventh conductor 93 and through an ohmmeter circuit 102 to an ohmmeter 95 at the control panel. The position of the rotary switch and the operation activated at such position is thereby monitored by the resistance indicated on the ohmmeter 95.

Rotary switch 250 at switch position 2 is connected for grounding the pressure transducer 126 monitoring circuit. This provides an indication of the switch position of switch 250.

The position of the backup shoe during extension and retraction of the shoe 20 and the position of the selected hydraulic core cutting means 30 during the cutting of a core are determined by position transducers 27 and 60 connected respectively to the rams 24 and 41 of the hydraulic cylinders 21 and 34. The position transducers 27 and 60 are connected in the electrical section 90 to a first resistance-to-frequency converter 202. The first converter 202 is connected through a line driver 204 to the seventh conductor cable 93 for transmitting a signal to the control panel means. At the control panel, the conductor 93 is connected through a frequency-to-voltage converter 96 to a volt meter 97 for monitoring the movement of the ram of the selected hydraulic cylinder.

The output of a pressure transducer 126 is also transmitted over the seventh conductor 93 for monitoring the pressure of the hydraulic system 120 during the bit rotation. Pressure transducer 126 is connected in the electrical section 90 through a second resistance-to-frequency converter 203 which is in turn connected through the line driver 204 to the seventh conductor cable 93 for transmitting a signal to the control panel. At the control panel, the conductor is connected through a frequency-to-voltage converter 98 to a volt meter 99 for monitoring the pressure of the hydraulic system 120. Rotary switch 250 is also connected to the second resistance-to-frequency converter 203 for grounding out converter 203 when rotary switch 250 is at position 2. At this switch position, pressure is applied for breaking a core from the formation and is indicated on the control panel by a maximum reading on the volt meter 99.

The first and second resistance-to-frequency converters 202 and 203 are selected to convert resistance inputs to different frequencies which can be easily separated at the control panel. The first resistance-to-frequency converter 202 is selected such that a low pass filter 100 having a cutoff frequency of 500 Hz will isolate the signals transmitted through the first converter 202. The second resistance-to-frequency converter 203 is selected such that a high-pass filter 101 having a cutoff frequency of 10 kH will isolate the signals transmitted through the second converter 203. The frequencies isolated at the control panel are sent to separate frequency-to-voltage converters 96 and 98 for respectively monitoring position and pressure.

A commercially available gamma ray logging apparatus is located in the electrical section 90 of the sidewall coring apparatus 10 and is connected to position 6 of rotary switch 200 such that when the backup shoe is in the retracted position, the gamma ray logging apparatus will be available for obtaining information concerning the formation adjacent the sidewall coring apparatus 10. The gamma ray or some commercially available logging device is desirable for properly positioning the coring apparatus 10 adjacent to the formation to be sampled.

With the aid of the gamma ray logging device, this embodiment of the coring apparatus can be used to locate and obtain up to eight samples each time the coring apparatus is lowered in a drill hole. Core 44 has a length of about one-half of the length of core barrel 33; therefore, each of the core cutting means 30 can be activated twice at selected locations in a drill hole for cutting a total of eight cores.

Figure 17:
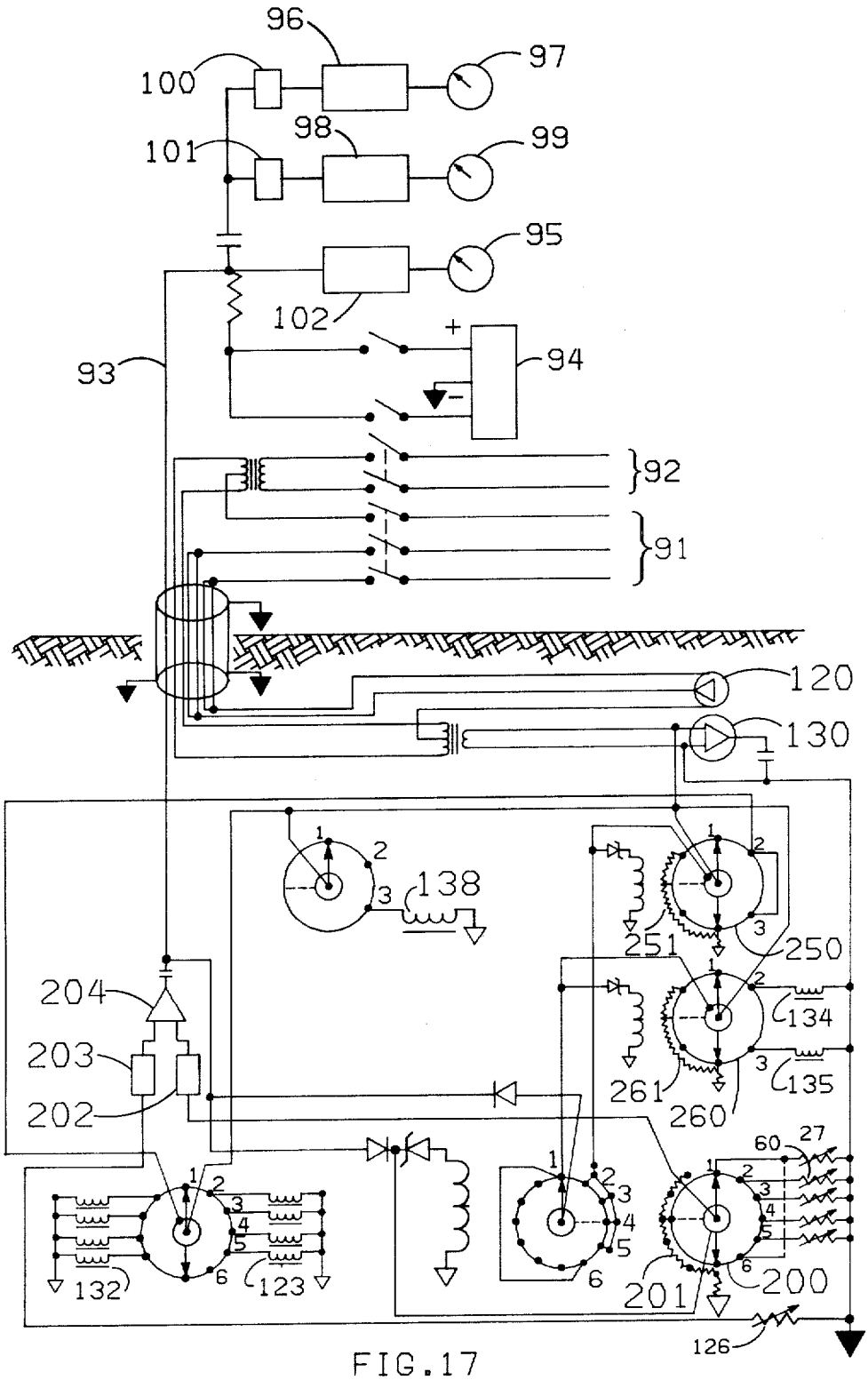
FIG. 17 is a schematic representation of the electrical operation and control systems of a second embodiment of the apparatus as shown in FIGS. 1 through 15.

In a second embodiment of the apparatus of this invention as described with respect to FIGS. 1–15, the operations are controlled by the use of three rotary switches 200, 250, and 260 as shown diagrammatically in FIG. 17. Rotary switch 200 is a 6 position switch and is connected for activating the backup shoe 20 for extension or retraction at positions 1 and 6 and for selectively activating each of the four hydraulic cutting means 30 at positions 2 through 5. At switch positions 1 and 6, rotary switch 260 is activated for controlling the extension and retraction of the backup shoe 20. Solenoid operated valve 134 within hydraulic system 130 for controlling the extension of the backup shoe 20 is connected at the second switch position of switch 260 and valve 135 for controlling the retraction of the backup shoe is connected at the third switch position. At switch positions 2 through 5 of switch 200 a selected valve 123 is opened for rotation of a core cutting means 30 and rotary switch 250 is activated for controlling the extension and retraction of the selected cutting means. The selected solenoid operated valve 132 within the hydraulic system 130 for controlling the extension of the selected cutting means 30 is connected at the second and third switch position of switch 250, also connected at the third switch position is selected valve 138 for breaking the core from the formation. The selected valve 132 is released to return to its normal closed position and valve 138 is released to return to its normally open position for retracting the cutting means at the first switch position. A positive voltage pulse transmitting over the seventh conductor 93 from the direct current power generator 94 causes the rotary switch 200 to advance one position, such as from position 1 to position 2. A negative voltage pulse transmitted over the seventh conductor causes the selected rotary switch 250 or 260 to advance one position. Rotary switch 200, 250, and 260 are connected to resistor strings 201, 251, and 261, respectively. These resistors are connected through the seventh conductor and through ohmmeter circuit 102 to a positive and negative reading ohmmeter 95 at the control panel. The switch position of rotary switch 200 is monitored with a positive voltage on conductor 93 and the switch position of selected switch 250 or 260 is monitored with a negative voltage on conductor 93.

The use of the three rotary switches as shown in FIG. 17 permits the selected operation of the backup shoe 20 and of one of a plurality of hydraulic cutting means 30. This independent operation can be important when the coring apparatus is held against the wall of the drill hole due to differential pressure between the drill hole and the formation adjacent to the drill hole or when a cutting means becomes lodged in a hole drilled by such cutting means. In either situation, rotary switch 200 would be advanced to its first or sixth switch position and rotary switch 260 would be advanced to its third switch position for retracting the backup shoe. Rotary switch 200 would then be advanced to a selected switch position of 2 through 5 and rotary switch 250 would be advanced to switch position three for applying the maximum pressure of hydraulic system 130 for prying the coring apparatus away from the sidewall of the drill hole. During this prying operation, hydraulic system 120 would not be activated for rotation of the core cutting means 30.

Figure 18:
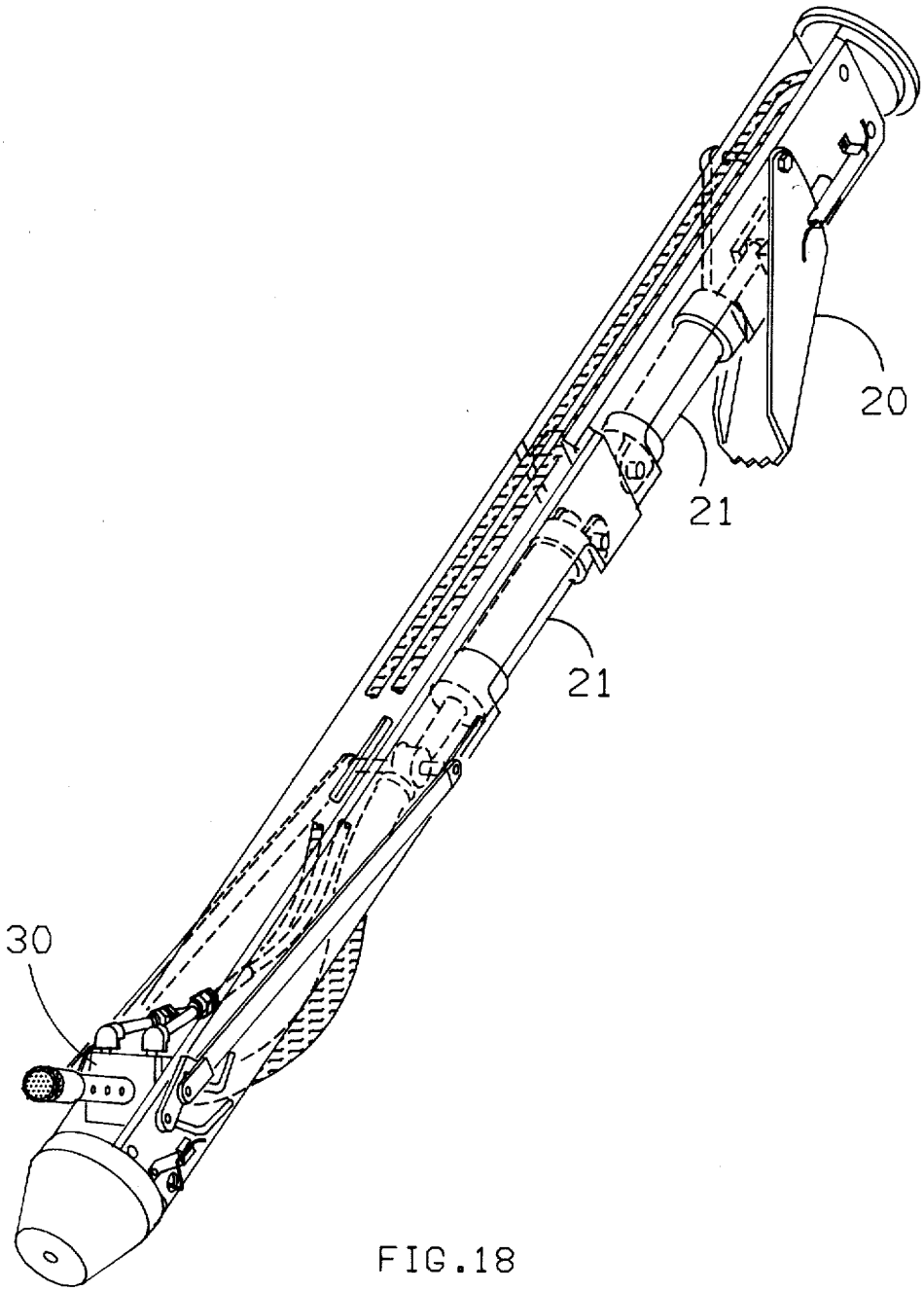
FIG. 18 is a schematic view depicting the mechanical section of a third embodiment of the apparatus of the present invention.

A third embodiment of the sidewall coring apparatus of the present invention is illustrated with respect to FIGS. 18 through 28. Mechanical features of this apparatus are illustrated in FIGS. 18–23, hydraulic features in FIGS. 24–27 and electrical features in FIG. 28. The principal mechanical features of this apparatus, as illustrated in FIG. 18, include a hydraulic coring means 30 and a hydraulically operated backup shoe means 20. In this embodiment, the backup shoe 20 and the coring means 30 are extended and retracted by separate double acting hydraulic cylinders 21. The extension and retraction of the backup shoe and the coring means are effected by separate signals from a control panel means. In FIG. 18, the backup shoe and coring means are depicted in extended positions.

Figure 19:
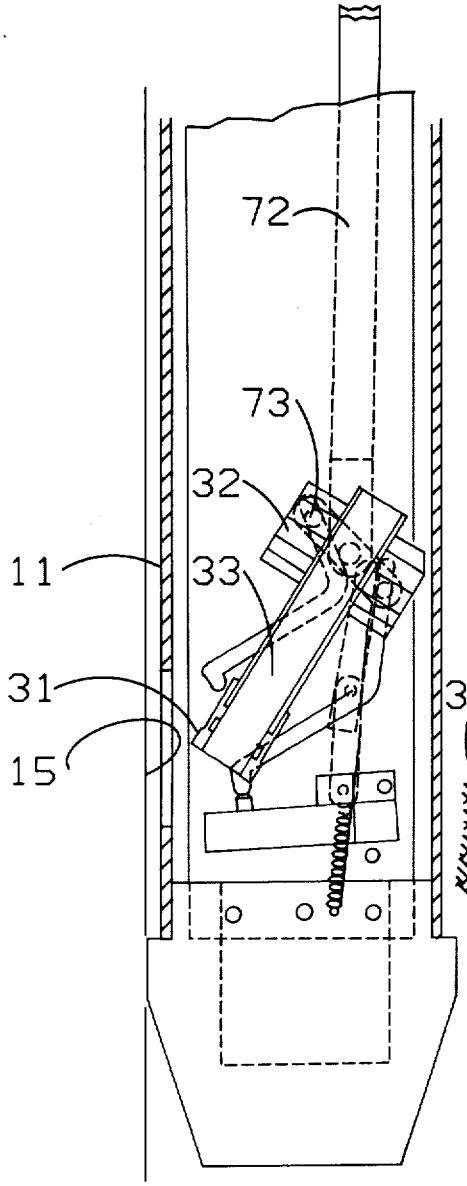
FIG. 19 is a schematic view depicting the hydraulic core cutting means of the third embodiment.

FIGS. 19–22 depict the operation of the hydraulic core cutting means 20 of this embodiment. As illustrated in FIG. 19, a core cutting head 31 is connected to hydraulic motor 32 for rotation about the longitudinal axis of a core retaining barrel 33. The hydraulic motor 32 is connected through connecting arm 72 at guide pin 73 to a double acting hydraulic cylinder 21, as shown in FIG. 18, for moving the core cutting head 31 through an opening in housing 11 and into cutting engagement with the sidewall of a drill hole 15.

Figure 20:
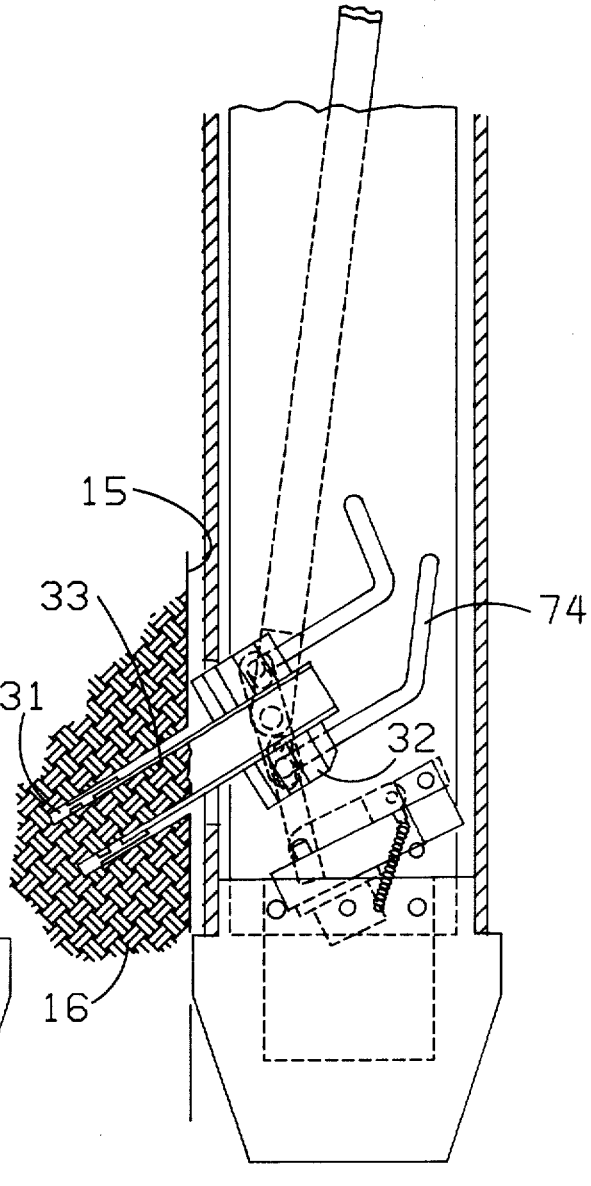
FIG. 20 is a schematic view depicting the core cutting means of FIG. 19 in the process of cutting a core.
Figure 21:
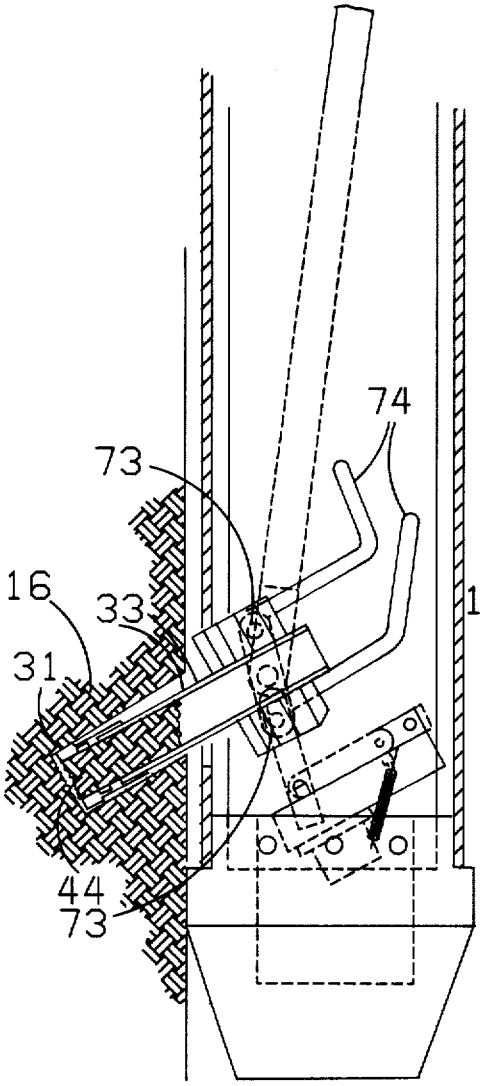
FIG. 21 is a schematic view depicting the core cutting means of FIG. 19 in the process of breaking a core from a formation.
Figure 22:
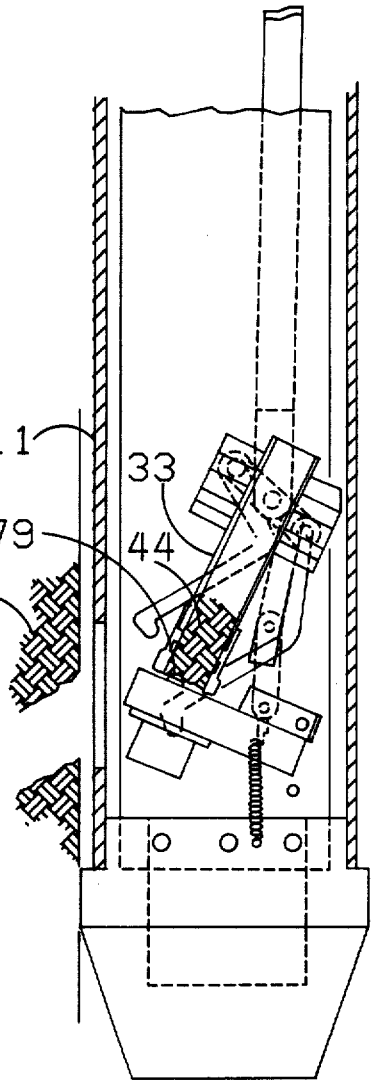
FIG. 22 is a schematic view depicting the core cutting means of FIG. 19 with a retained core.
Figure 24:
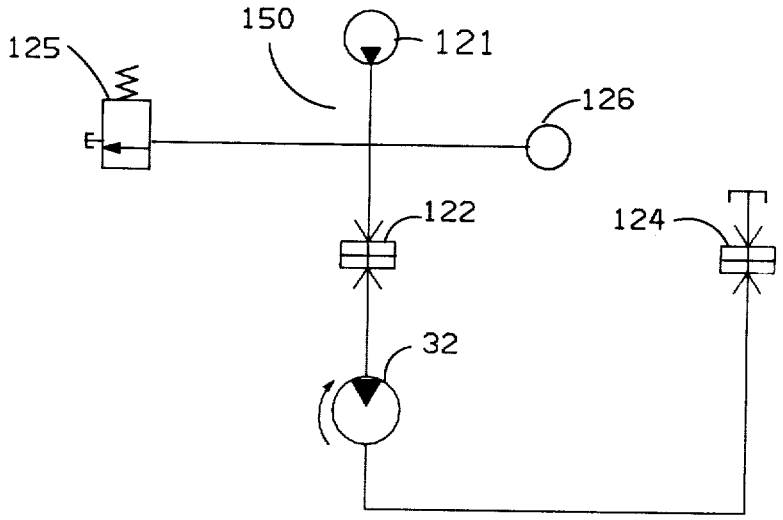
FIG. 24 is a schematic representation of the hydraulic system of the third embodiment which operates the hydraulic motor of the core cutting means.

Operation of the hydraulic core cutting means 30 is depicted during the cutting of a subterranean formation core in FIG. 20, during the breaking of the core 44 from the subterranean formation 16 in FIG. 21 and as retaining the core 44 within the housing in FIG. 22. By energizing the high volume hydraulic system as shown in FIG. 24, the hydraulic motor 32 rotates the core cutting head 31 about the longitudinal axis of the core retaining barrel 33. By signal from the control panel means, hydraulic cylinder 21 is activated for moving the hydraulic motor 32 along guide slot 74 to thereby urge the rotating core cutting head 31 into engagement with the sidewall of the drill hole 15.

It is shown in FIG. 21 that the guide pins 73 have advanced to the ends of the guide slots 74 which have been expanded to provide for the deflection of the core barrel 33 within the hole drilled by the core cutting means 30. This deflection of the core retaining barrel separates a core 44 from the remainder of the formation 16. By separate signal, the core cutting means 30 is retracted to its resting position without the housing 11. At this resting position, as shown in FIG. 22, contact switch 79 impinges on core 44 and transmits a signal to the control panel means for indicating the presence of core 44 within core retaining barrel 33.

Figure 23:
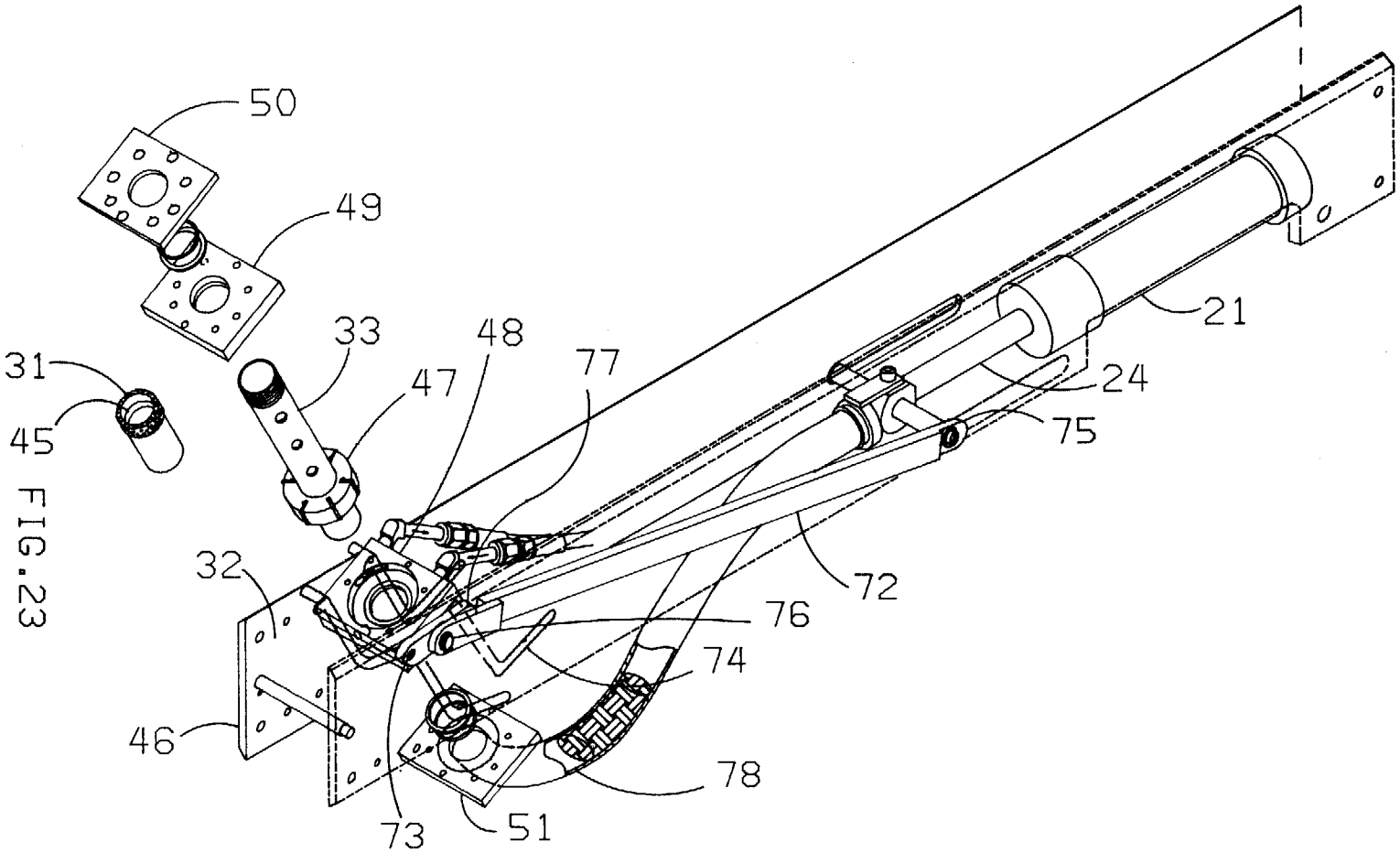
FIG. 23 is an isometric view depicting the core cutting means of the third embodiment.

Details of the hydraulic core cutting means 30 are illustrated in FIG. 23. Connected to support structure 46 is hydraulic cylinder 21 which activates ram 24 to move the core cutting head 31 into coring engagement with the sidewall of a drill hole. Ram 24 is connected to the hydraulic motor 32 through arms 72. The arms 72 are connected to the ram 24 at connecting pins 75 and through pivot pin 76 on connecting arms 77 to guide pins 73 on the body of the hydraulic motor 32. This isometric drawing of the hydraulic motors 32 shows that the core barrel 33 extends through and is an integral part of the motor, with rotor 47 being securely attached to the core barrel 33 for operation within the motor body 48. The motor is sealed by bearing plates 49 and pressure plates 50 and 51. Additional details of the hydraulic motor are shown in FIGS. 11 and 12.

The guide pins 73, as guide track engaging means, are connected to the body 48 of the hydraulic motor 32 and move within guide slots 74, as a guide track, of support 46. The upper portions of guide slots 74 are expanded to provide for the deflection of the hydraulic motor 32 at about right angles from its path of travel along the guide slots while cutting a core. As previously described, the deflection of the hydraulic motor 32 and core barrel 33 causes a core to be broken from the formation.

A core storage means 78 such as a bicycle inner tube is connected to the hydraulic motor 32 at pressure plates 51 for receiving cores from core barrel 33. The core is retained in core barrel 33 by a snap-in core retaining ring 45. Additional cores cut by core cutting head 31 will force the cores through the retaining ring 45 and into the core storage means 78.

Figure 25:
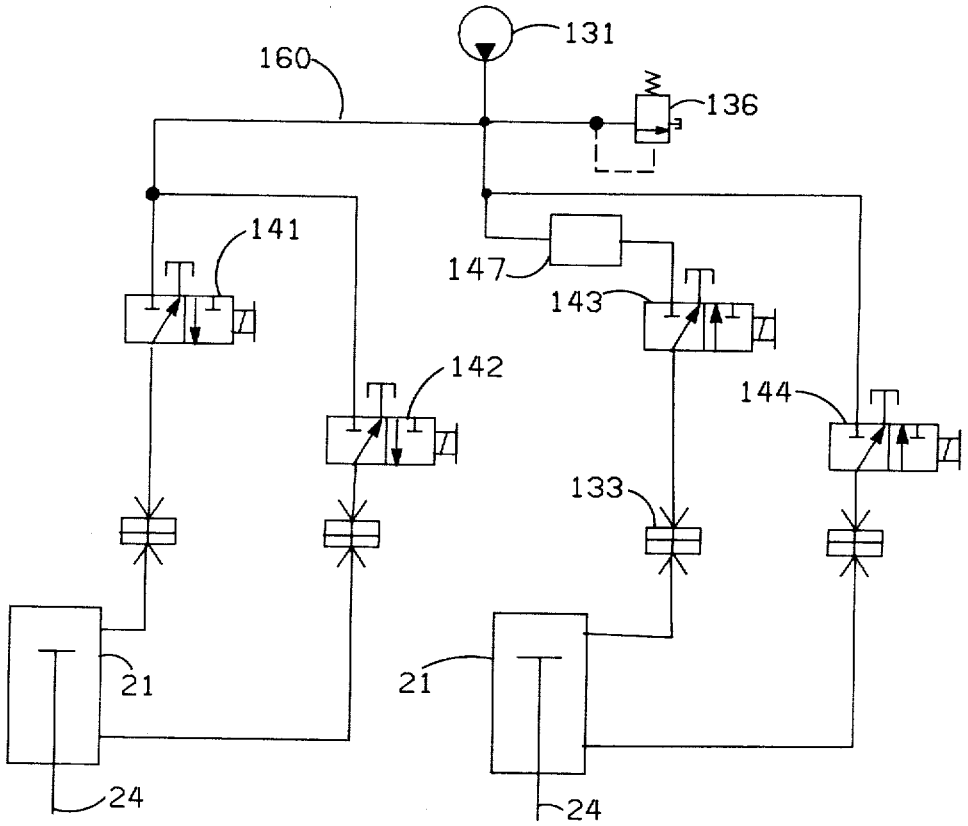
FIG. 25 is a schematic representation of the hydraulic system of the third embodiment which operates the hydraulic cylinders of the backup shoe and core cutting means.

Backup shoe means 20 and core cutting means 30 are operated by hydraulic pressure supplied by two hydraulic systems 150 and 160 shown diagrammatically in FIGS. 24 and 25. The high volume hydraulic system 150 as shown in FIG. 24, provides the hydraulic fluid for operating the hydraulic motor 32 and is operated by a 7 gallon per minute hydraulic pump 121 driven by a 1 horsepower, 440 volt, alternating current, 3 phase electric motor. This high volume hydraulic pump 121 is located in the hydraulic section 80 of the coring apparatus of this third embodiment and is connected to the hydraulic motor 32 through bulkhead connector 122. Hydraulic system 150 is also provided with a pressure relief valve 125 and a pressure transducer 126.

Hydraulic system 150 is activated to supply hydraulic fluid for causing the rotation of the cutting head 31 connected to the motor 32. The exhaust from the motor 32 will flow into the hydraulic fluid reservoir in the hydraulic section through bulk head connector 124.

The low volume hydraulic system 160, as shown in FIG. 25 provides the hydraulic fluid for extension and retraction of backup shoe 20 and core cutting means 30. This hydraulic system is operated by a low volume hydraulic pump driven by a 120 volt, alternating current, single phase electric motor. This hydraulic pump 131 is located in the hydraulic section of the coring apparatus and is connected to the double acting hydraulic cylinders 21 of the backup shoe 20 and the core cutting means 30 through solenoid operated, 3-way, normally closed valves 141, 142, 143, and 144 and bulkhead connectors 133.

Hydraulic system 160 is provided with a high pressure relief valve 136 and a flow restrictor valve 147 for controlling the pressure applied to urge the core cutting means 30 into coring engagement with the sidewall of a drill hole. Valve 147 is connected to hydraulic system 150 such that pressure increases in system 150 will reduce the supply of fluid in system 160 for extending the core cutting means. A pressure increase in system 150 indicates that hydraulic motor 32 is operating at a higher torque. The increase in pressure will result in the closing of valve 147, thereby reducing the supply of fluid in system 160 for extending the core cutting means.

Figure 26:
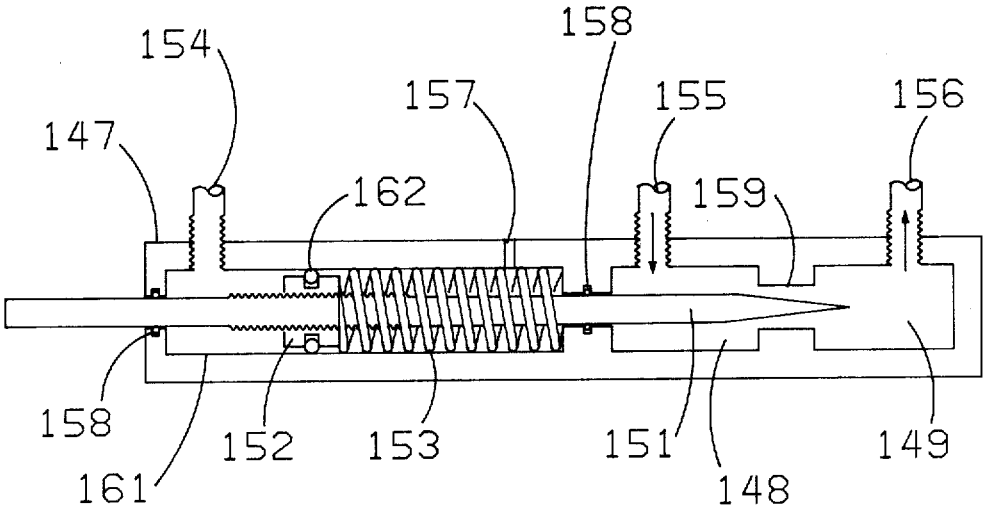
FIG. 26 is a schematic view depicting the flow restrictor valve in the hydraulic system of FIG. 25 with a partially restricted orifice.
Figure 27:
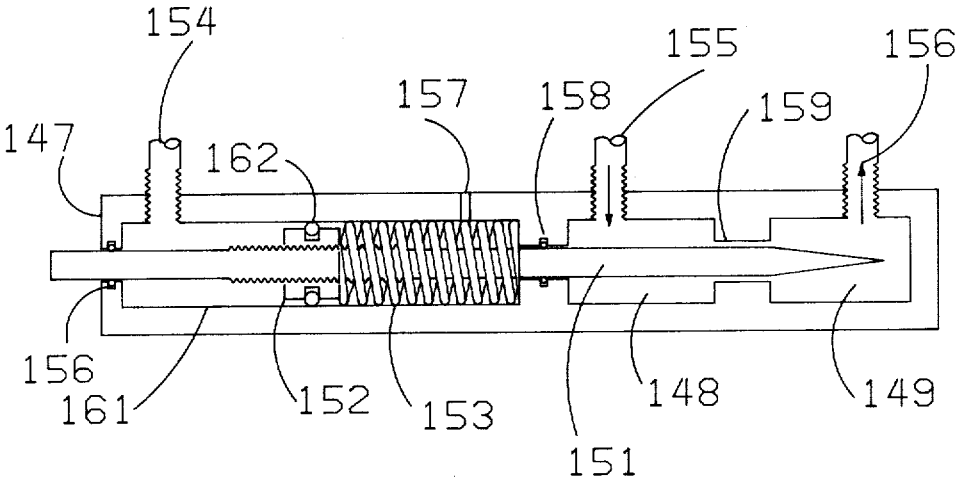
FIG. 27 is a schematic view depicting the flow restrictor valve of FIG. 26 with a substantially restricted orifice.

Flow restrictor valve 147 is illustrated in FIGS. 26 and 27. In this embodiment of the use of this valve 147, fluid from pump 131 of hydraulic system 160 enters the high pressure chamber 148 through conduit 155 and passes through orifice 159 to low pressure chamber 149 and then through conduit 156 to valve 143 of hydraulic system 160. The flow of fluid through the orifice is controlled by orifice restricting means 151.

Fluid from hydraulic system 150 enters cylinder 161 through conduit 154 and acts through piston 152 to compress spring 153, thereby adjusting the flow of fluid through orifice 159. This provides opposing control fluid and spring means for adjusting the flow of fluid through orifice 159. It is shown in FIG. 26 that the flow of fluid through orifice 159 is partially restricted by flow restrictor 151 and in FIG. 27 that the flow of fluid is substantially restricted.

Piston 152 is threadably connected to a slender pointed rod which functions as flow restrictor 151 for adjusting the flow through orifice 159. The strength of spring 153 can also be selected for adjusting the flow through orifice 159. Chamber 161 is sealed at seals 158 of the openings from cylinder 161 through which flow restrictor 151 passes to prevent fluid communication and has a bleed port 157 for bleeding any hydraulic fluid that may bypass piston 152. Cylinder 161 and piston 152 have machined mating surfaces to provide for movement of piston 152 through cylinder 161 and to minimize the fluid from hydraulic system 150 which bypasses piston 152 and bleeds from cylinder 161 through bleed port 157. O-Ring seal 162 is also provided to minimize the bypassing of fluid.

To break a core from the sidewall of a drill hole, hydraulic pump 121 in hydraulic system 150 is shut down. This permits the spring in valve 147 to move the slender pointed rod 151 away from orifice 159 and the full force of the fluid in hydraulic system 160 is applied through valve 143 and cylinder 21 to break the core.

Figure 28:
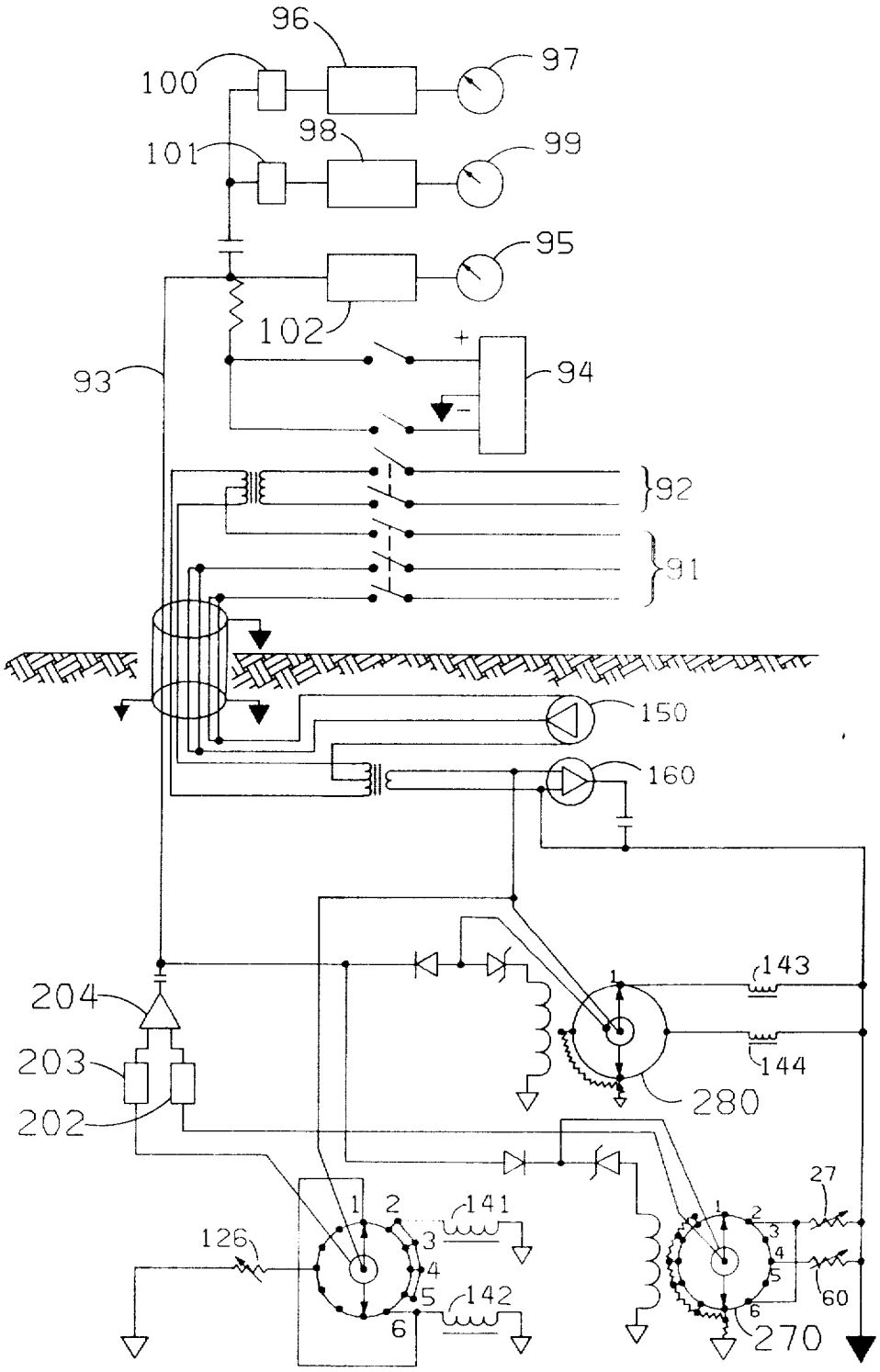
FIG. 28 is a schematic representation of the electrical operation and control systems of the third embodiment.

The sidewall coring apparatus of this embodiment is operated on a standard seven conductor wireline logging cable with the power for the operation of the hydraulic system being transmitted over six of the conductors and the seventh conductor being used for monitoring and control operations. The control operations, as shown in FIG. 28, are effected by two rotary switches 270 and 280. Rotary 270 is a sixth position switch and is used for controlling the operation of the backup shoe 20. Rotary switch 280 is a two position switch and is used for controlling the operation of the core cutting means 30.

At rotary switch positions 2 through 5 of rotary switch 270, solenoid valve 141 would be open for extension of the ram 24 of hydraulic cylinder 21 connected to the backup shoe 20 to thereby wedge the core cutting apparatus 10 in a drill hole. At switch positions 1 and 6, valve 142 would be open for retracting the backup shoe 20.

The position of switch 270 is monitored with a positive and negative reading ohmmeter 95 connected to the seventh conductor at the control panel means. The switch position is monitored on ohmmeter 95 with a positive voltage on conductor 93. A positive direct current pulse transmitted over the seventh conductor 93 causes rotary switch 270 to advance one position.

At the first switch position of rotary switch 280, solenoid operated valve 143 is opened for extending the ram 24 of hydraulic cylinder 21 connected to the core cutting means 30 to thereby extend the core cutting means into engagement with the sidewall of a drill hole. At the second switch position, valve 144 is open for retracting the core cutting means.

The position of rotary switch 280 is monitored on ohmmeter 95 with a negative voltage on conductor 93 and switch 280 is advanced by a negative direct current pulse transmitted over conductor 93.

The embodiments described above illustrate methods and apparatus useful for practicing the present invention, and the apparatus shown in the drawings is considered illustrative of the invention. Although this apparatus is described for use in an oil well drill hole to obtain formation samples, it is understood that it can be adapted to drill into the sidewalls of drill holes. For example, it is contemplated that the drill head 31 can be modified by those skilled in the art for drilling into the sidewall of any cased or open drill hole to produce an opening or to obtain a sample of the casing and cementing material lining the drill hole. It is also contemplated that equipment can be included in the coring apparatus for determining the orientation of the apparatus with respect to true or magnetic north. Other changes in the design and structure of the apparatus described above may be made by one skilled in the art without departing from the spirit and scope of this invention.

What is claimed is:

1. An apparatus for drilling into the sidewall of a drill hole which comprises:

a support member, a shoe means mounted to said support member for movement toward and away from the sidewall of a drill hole, a hydraulic motor means mounted to said support member for movement along track means toward and away from the sidewall of a drill hole, wherein said motor means comprises a rotor, a downhole hydraulic power source remotely actuatable for radially driving said rotor, downhole power means independent of said hydraulic motor means for moving said motor means along said track means, and a drilling bit means connected to said rotor for drilling a hole.

2. The apparatus of claim 1 wherein said support member is enclosed within a housing means having an opening through which said shoe means can move for wedging said housing means at a location in the drill hole and an opening through which said drilling bit means can move to drill a hole in the sidewall of the drill hole.

3. The apparatus of claim 1 wherein said drilling bit means comprises a core drilling bit connected through a core retaining barrel means to the rotor of said hydraulic motor for cutting a core from the sidewall of a drill hole and retaining said core.

4. The apparatus of claim 1 wherein said apparatus comprises a spring hydraulic motor retracting means for urging said hydraulic motor means to remain at a location on said support member.

5. An apparatus for cutting a core from the sidewall of a drill hole penetrating a subterranean formation which comprises:

an elongated housing means having an opening through which a shoe means can move to wedge said housing means at a location in the drill hole and an opening through which a core drilling bit means can move to cut a core from the sidewall of the drill hole, a shoe means mounted within said housing means for movement through said shoe means opening in said housing means for releasably wedging said housing means at a location in the drill hole, a hydraulic motor means mounted in said housing means for movement toward and away from said drilling means opening in said housing means, wherein said motor means comprise a rotor, closed hydraulic power source means supported by said housing for moving and operating said hydraulic motor, and a core drilling bit means connected to a core retaining barrel means to said rotor for cutting a core from the sidewall of the drill hole and for retaining said core.

6. The apparatus of claim 5 wherein said apparatus comprises a means connected to said housing means for deflecting said core retaining barrel means at the completion of cutting a core.

7. The apparatus of claim 5 wherein said apparatus comprises a spring hydraulic motor retracting means for urging said hydraulic motor means to remain at a location within said housing means.

8. The apparatus of claim 5 wherein said core retaining barrel means is an integral part of said hydraulic motor.

9. The apparatus of claim 5 wherein said core retaining barrel means extends through the rotor of said hydraulic motor.

10. The apparatus of claims 1 or 5 which comprises a position transducer means connected to said shoe means for generating a signal which is indicative of the position of the shoe means, wherein said position transducer means is connected through a converter for converting the signals from the position transducer to a frequency signal to one dedicated conductor of a multiconductor wireline logging cable and to a filter at the control means for isolating the frequency signal and then to a frequency to monitoring signal converter and finally to a means for monitoring the signal generated by said position transducer means.

11. The apparatus of claims 1 or 5 which comprises:

a first rotary switch which is advanced by a direct current voltage pulse and is connected through one dedicated conductor of a multiconductor wireline logging cable to a control means and, at one switch position, to the shoe means for wedging the apparatus within the drill hole and, at a separate switch position, to the shoe means for releasing the apparatus for movement through the drill hole, and a second rotary switch which is advanced by a direct current voltage pulse and is connected through said dedicated conductor to said control means and, at a switch position, to said hydraulic motor means for moving said drilling bit means into drilling engagement with the sidewall of a drill hole and, at a separate switch position, for retracting the drilling bit means, wherein one of said rotary switches is advanced in response to a positive direct current pulse and the other said rotary switch is advanced in response to a negative direct current pulse, both separately transmitted through said dedicated conductor.

12. A method of drilling into the sidewall of a drill hole penetrating a subterranean formation which comprises:

positioning at a selected location in the drill hole an apparatus for drilling into the sidewall of a drill hole, wherein said apparatus comprises a support member, a shoe means mounted to said support member for movement toward and away from the sidewall of a drill hole, a hydraulic motor means mounted to said support member from movement along track means toward and away from the sidewall of a drill hole wherein said rotor means comprises a rotor, and a drilling bit means connected to said rotor for drilling a hole, activating said shoe means for wedging said apparatus at said location, activating a downhole hydraulic power source from the surface for radially driving said rotor; providing downhole power means independent of said hydraulic motor means to move said motor means along said track means into drilling engagement with the sidewall of the drill hole, followed by retracting said drilling bit means and then said shoe means and removing said apparatus from said drill hole.

13. A method of cutting a core from the sidewall of a drill hole penetrating a subterranean formation which comprises:

positioning at a selected location in the drill hole an apparatus which comprises an elongated housing means having an opening through which a shoe means can move to wedge said housing means at a location in the drill hole and an opening through which a core drilling bit means can move to cut a core from the sidewall of the drill hole, a shoe means mounted within said elongated housing means for movement through said shoe means opening in said housing means for releasably wedging said housing means at a location in the drill hole, a hydraulic motor means which comprises a rotor mounted in said housing means for movement toward and away from said drilling means opening in said housing means, closed hydraulic power source means supported by said housing means for moving and operating said hydraulic motor, and a core drilling bit means connected through a core retaining barrel means to the rotor of said hydraulic motor for cutting a core from the sidewall of the drill hole and for retaining said core, and activating said shoe means for wedging said housing means at a selected location, followed by activating said hydraulic motor means for rotating said core drilling bit and moving said drilling bit means into drilling engagement with the sidewall of the drill hole for cutting a core from the sidewall of the drill hole by remotely operating said closed hydraulic power source means, followed by retracting said core drilling bit means and then said shoe means to within said housing means and removing said apparatus from said drill hole.

14. An apparatus for drilling into the sidewall of a drill hole which comprises:

a support member, a shoe means mounted on said support member for movement toward and away from the sidewall of a drill hole, motor means mounted to said support member for movement toward and away from the sidewall of a drill hole so that said motor means can be extended outwardly, wherein said motor means comprises a rotor, conveying means for moving said motor means toward and away from the sidewall, a drilling bit means connected to the rotor of and comprising a core drilling bit connected through a core retaining barrel means to the rotor of said motor for cutting a core from the sidewall, means supported by said support member for deflecting the end of said core retaining barrel farthest from said sidewall while said barrel is extended.

15. An apparatus for drilling into the sidewall of a drill hole which comprises:

support member;

a shoe means mounted to said support member for movement toward and away from the sidewall of a drill hole, a motor means mounted to said support member for movement toward and away from the sidewall of a drill hole in which said motor means comprises a rotor, drilling bit means comprising a core drilling bit connected to be driven by the rotor of said motor for cutting a core from the sidewall and a core retaining barrel for retaining said core, means for moving said motor means toward and away from said sidewall which includes a first and a second hydraulic ram supported by said support member on opposite sides of said motor means and arranged so that upon extension of said rams said motor means is driven toward said sidewall and stop means supported by said support member to limit the extension of one of said rams.

16. Apparatus as defined in claim 14 or 15 including guidetrack means supported by said support member in which its path extends from within said support member and extends toward an opening in said support member and guide means mounted on said motor means for following said track means.

17. An apparatus for drilling into the sidewall of a drill hole which comprises:

a support member, a shoe means mounted to said support member for movement toward and away from the sidewall, a motor means mounted to said support member for movement toward and away from the sidewall of a drill hole wherein said motor means includes a rotor, a core drilling bit means connecting a core retaining barrel means to said rotor for cutting a core from said sidewall for retaining said core, guide-track means mounted within said support member extending in essentially a straight line from within said support member to an opening in the wall therein, guide-track engaging means carried by said motor means for engaging said guide-track means to guide the path of said motor means toward and away from the sidewall, means to move said motor at about right angles to the longitudinal axis of said core retaining barrel when said motor means has reached a preselected position along said track means.

18. A method of drilling into the sidewall of a drill hole penetrating a subterranean formation which comprises:

positioning at a selected location in said drill hole an apparatus for drilling into the sidewall of a drill hole, wherein said apparatus comprises a support member, a shoe means mounted to said support member for movement toward and away from the sidewall of a drill hole, a means which comprises a rotor mounted to said support member for movement toward and away from the sidewall of the drill hole, and a drilling bit means connected to said rotor for drilling a hole, activating said shoe means for holding said apparatus at said selected location, followed by activating said motor means for rotating said drilling bit and moving said drilling bit means into drilling engagement with the sidewall of the drill hole and cutting a core which extends into a core retaining barrel, moving one end of said core retaining barrel containing said core at approximately right angle to its longitudinal axis while said barrel is extended, whereby the cut core is broken from said sidewall, retracting said drilling bit means, said core retaining barrel and core, and said shoe means and then removing said apparatus from said drill hole.

19. A method is defined in claim 18 in which the step of moving said core barrel at right angles comprises providing a ram on opposite sides of said barrel, wherein said two rams are connected to said core retaining barrel by a continuous line and stopping the movement of one ram while continuing advancing the other ram.

20. An apparatus for drilling into the sidewall of a borehole which comprises:

a support member;

a shoe means mounted on said support member;

means for moving said shoe means toward and away from said sidewall;

motor means supported by said support member;

conveying means for moving said motor means toward and away from said sidewall so that said motor means can be extended toward said sidewall;

a drilling bit means driven by said motor means and comprising a core retaining barrel means and a core cutting bit;

means connected to said support member for deflecting one end of said core retaining barrel while said barrel is extended.

21. An apparatus for drilling into the sidewall of a drill hole which comprises:

a shoe means mounted to said support member for movement toward and away from the sidewall of a borehole;

a motor means mounted to said support member for movement toward and away from the sidewall of a drill hole in which said motor means includes a rotor;

drilling bit means comprising a core drilling bit connected to a core retaining barrel means to be driven by the rotor of said motor means for cutting a core from the sidewall;

means for moving said motor means toward and away from said sidewall which includes a guide-track means supported by said support member having a path extending from within said support member toward an opening in said support member, the first part of said path being substantially a straight line and the outer end of the said path having an abrupt path change of approximately a right angle, and guide means mounted on said motor means for following the path of said track means and moving said motor means at substantially right angles to its previous direction upon said guide means reaching said outer end.

22. An apparatus for drilling into the sidewall of a drill hole which comprises:

a support member, a shoe means mounted to said support member for movement toward and away from the sidewall of a drill hole, a hydraulic motor means mounted to said support member for movement toward and away from the sidewall of a drill hole, wherein said motor means comprises a rotor, drilling bit means connected to said rotor for drilling a hole, wherein said drilling bit means comprises a core drilling bit connected through a core retaining barrel means to the rotor of said hydraulic motor for cutting a core from the sidewall of a drill hole upon extending said hydraulic motor means toward said sidewall;

means connected to said support member for deflecting said core retaining barrel means at the completion of cutting a core while said hydraulic motor means is extended toward said sidewall.

23. An apparatus for cutting a core from the sidewall of a drill hole penetrating a subterranean formation which comprises:

an elongated housing means having an opening through which a shoe means can move to wedge said housing means at a location in the drill hole and an opening through which a core drilling bit means can move to cut a core from a sidewall of a drill hole, a shoe means mounted within said housing means for movement through said shoe means opening in said housing means for releasably wedging said housing means in a location in the drill hole, a hydraulic motor means mounted in said housing means for movement toward and away from said drilling means opening in said housing means so that said hydraulic motor means can be extended, and wherein said motor means comprises a rotor, a core drilling bit means connected through a core retaining barrel means to said motor for cutting a core from the sidewall of a drill hole and for retaining said core, means connected to said housing means for deflecting said core retaining barrel means at the completion of cutting a core while said core retaining barrel means is extended.

24. An apparatus for drilling into the sidewall of a drill hole which comprises:

a support member, a shoe means mounted to said support member for movement toward and away from the sidewall of a drill hole, a hydraulic motor means mounted to said support member for movement toward and away from the sidewall of a drill hole, wherein said motor means comprises a rotor, a drilling bit means connected to said rotor for drilling a hole, a position transducer means connected to said shoe means for generating a signal which is indicative of the position of the shoe means, wherein said position transducer means is connected through a converter for converting the signals from the position transducer to a frequency signal to one dedicated conductor of a multi-conductor wireline logging cable and to a filter at the control means for isolating the frequency signal and then to a frequency-to-voltage signal converter and finally to a means for monitoring the signal generated by said position transducer means.

25. An apparatus for drilling into the sidewall of a drill hole which comprises:

a support member, a shoe means mounted to said support member for movement toward and away from the sidewall of a drill hole, a hydraulic motor means mounted to said support member for movement toward and away from the sidewall of a drill hole, wherein said motor means comprises a rotor, a drilling bit means connected to said rotor for drilling a hole, a first rotary switch which is advanced by a direct current voltage pulse and is connected through one dedicated conductor of a multi-conductor wireline logging cable to a control means and, at one switch position, to the shoe means for wedging the apparatus within the drill hole and, at a separate switch position, to the shoe means for releasing the apparatus for movement to the drill hole, and a second rotary switch which is advanced by a direct current voltage pulse and is connected through said dedicated conductor to said control means and, at a switch position, to said hydraulic motor means for moving said drilling bit means into drilling engagement with the sidewall of a drill hole and, at a separate switch position, for retracting the drilling bit means, wherein one of said rotary switches is advanced in response to a positive direct current pulse and the other said rotary switch is advanced in response to a negative direct current pulse, both separately transmitted through said dedicated conductor.

26. An apparatus for cutting a hole from the sidewall of a drill hole penetrating a subterranean formation which comprises:

an elongated housing means having an opening through which a shoe means can move to wedge said housing means at a location in the drill hole and an opening through which a core drilling bit means can move to cut a core from the sidewall of a drill hole, a shoe means mounted within said housing means for movement through said shoe means opening in said housing means for releasably wedging said housing means at a location in the drill hole, a hydraulic motor means mounted in said housing means for movement toward and away from said drilling means opening in said housing means, wherein said motor means comprises a rotor, a core drilling bit means connected through a core retaining barrel means to said rotor for cutting a core from the sidewall of the drill hole and for retaining said core, a first rotary switch which is advanced by a direct current voltage pulse and is connected through one dedicated conductor of a multi-conductor wireline logging cable to a control means and, at one switch position, to the shoe means for wedging the apparatus within the drill hole and, at a separate switch position, to the shoe means for releasing the apparatus for movement through the drill hole, and a second rotary switch which is advanced by a direct current voltage pulse and is connected through said dedicated conductor to said control means and, at a switch position, to said hydraulic motor means for moving said drilling bit means into drilling engagement with the sidewall of a drill hole and, at a separate switch position, for retracting the drilling bit means, wherein one of the rotary switches is advanced in response to a positive direct current pulse and the other said rotary switch is advanced in response to a negative direct current pulse, both separately transmitted through said dedicated conductor.

27. The apparatus of claim 25 or 26 which comprises:

a position transducer means connected to said shoe means for generating a signal which is indicative of the position of the shoe means and a separate position transducer means connected to said hydraulic motor means for generating a signal which is indicative of the position of the drilling bit means, wherein said position transducer means are separately connected through a first converter for converting the signals from the position transducers to a first frequency signal to said dedicated conductor and to a first filter at said control means for isolating the first frequency signal, then to a first frequency to monitoring signal converter, and finally to a means for monitoring the signal generated by said position transducer means, wherein said transducer means connected to said shoe means is activated for generating a signal when said shoe means is being advanced or retracted and wherein said transducer means connected to said hydraulic motor means is activated for generating a signal when said drilling bit means is activating for drilling, and a pressure transducer means connected to said hydraulic motor means for generating a signal which is indicative of the pressure being applied to rotate the rotor of the hydraulic motor means, wherein said pressure transducer means is connected to a second converter for converting the signal from the pressure transducer means to a second frequency which is distinct from said first frequency signal to said dedicated conductor and through a second filter at said control means for isolating said second signal and through a second frequency to monitoring signal converter, and finally to a means for monitoring the signal generated by said pressure transducer means.

28. The apparatus of claim 25 or 26 which comprises a resistor means connected to said first rotary switch and through said dedicated conductor to resistance measuring means at said control means for registering a separate reading on said resistance measuring means at each switch position.

29. The apparatus of claim 25 or 26 which comprises a resistor means connected to said first rotary switch and through said dedicated conductor to an ohmmeter means at said control means for registering a separate reading on said ohmmeter means at each switch position.

30. An apparatus for drilling into the sidewall of a borehole which comprises:

a support member, a shoe means mounted in said support member, means for moving said shoe means toward and away from said sidewall, motor means supported by said support member, conveying means for moving said motor means toward and away from said sidewall, a drilling bit means driven by said motor means and comprising a core retaining barrels means and a core cutting bit, deflecting means for deflecting the end of said retaining barrel opposite of said borehole and including guide-track means supported by said support member and having a path extending from within said support member toward an opening in said support member and guide means carried by said motor means for following said track means, the inner part of said path being a continuous curve and the outer end of said guide-track means having an abrupt deviation in its path so that said motor means is deflected from its previous motion.

31. An apparatus for cutting a core from the sidewall of a drill hole penetrating a subterranean formation which comprises:

an elongated housing means having an opening through which a shoe means can move to wedge said housing means at a location in the drill hole and an opening through which a core drilling bit means can move to cut a core from the sidewall of a drill hole, a shoe means mounted within said housing means for movement through said shoe means opening in said housing means for releasably wedging said housing means at a location in the drill hole, a hydraulic motor means mounted in said housing means for movement toward and away from said drilling means opening in said housing means, wherein said motor means comprises a rotor, a core drilling bit means connected through a core retaining barrel means to said rotor for cutting a core from the sidewall of the drill hole and for retaining said core and wherein said core retaining barrel means extends through the rotor of said hydraulic motor.

32. An apparatus for cutting a core from the sidewall of a drill hole penetrating a subterranean formation which comprises:

an elongated housing means having an opening through which a shoe means can move to wedge said housing means at a location in the drill hole and an opening through which a core drilling bit means can move to cut a core from the sidewall of the drill hole, a shoe means mounted within said housing means for movement through said shoe means opening in said housing means for releasably wedging said housing means at a location in the drill hole, a hydraulic motor means mounted in said housing means for movement toward and away from said drilling means opening in said housing means, wherein said motor means comprises a rotor, a core drilling bit means connected through a core retaining barrel means to said rotor for cutting a core from the sidewall of a drill hole and retaining said core, a position transducer means connected to said shoe means for generating a signal which is indicative of the position of the shoe means, wherein said position transducer means is connected through a converter for converting the signals from the position transducer to a frequency signal to one dedicated conductor of a multi-conductor wireline logging cable and to a filter at the control means for isolating the frequency signal and then to a frequency-to-voltage signal converter and finally to a means for monitoring the signal generated by said position transducer means.

33. A method of drilling into the sidewall of a borehole penetrating a subterranean formation which comprises:

positioning at a selected location in said borehole an apparatus for drilling into the sidewall of said borehole wherein said apparatus comprises a motor means, a support member for supporting said motor means in said borehole, said motor means including a hollow rotor and a drilling bit means have a core retaining barrel, positioning said support member at a selected location, followed by activating said motor means for rotating said drilling bit, and moving said drilling bit into drilling engagement with the sidewall borehole, cutting a core which extends into said core retaining barrel, continue cutting a second core that drives that first core from said core retaining barrel through the rotor of said motor means to a core storage container, breaking the cut core from the sidewall by moving one end of said core retaining barrel containing said core at approximately right angles to its longitudinal axis.

34. A method of drilling into the sidewall of a drill hole penetrating a subterranean formation which comprises:

positioning at a selected location in the drive hole an apparatus for drilling into the sidewall of a drill hole, wherein said apparatus comprises a support member, a shoe means mounted to said support member for movement toward and away from the sidewall of a drill hole, a hydraulic motor means which comprises a rotor mounted to said support member for movement toward and away from the sidewall of a drill hole, and a drilling bit means connected to said rotor for drilling a hole, activating said shoe means for wedging said apparatus at said selected location, followed by activating said hydraulic motor means for rotating said drilling bit and moving said drilling bit means into drilling engagement with sidewall drill hole, connecting a position transducer means to said motor means for generating a signal which is indicative of the position of the bit means, connecting said position transducer means through a converter for converting the signal from the position transducer to a frequency signals to one dedicated conductor of a multi-conductor wireline logging cable and to a filter at the control means for isolating the frequency signal and then to a frequency-to-voltage signal converter and finally to a means for monitoring the signal generated by said position transducer means;

retracting said drilling bit means and then said shoe means and then moving said apparatus from said drill hole,

35. A method of drilling into the sidewall of a drill hole penetrating a subterranean formation which comprises:

positioning at a selected location in the drill hole an apparatus for drilling into the sidewall of a drill hole, wherein said apparatus comprises a support member, a shoe means mounted to said support member for movement toward and away from the sidewall of a drill hole, a hydraulic motor means which comprises a rotor mounted to said support member for movement toward and away from the sidewall of a drill hole, and a drilling bit means connected to said rotor for drilling a hole, activating said shoe means for wedging said apparatus at said selected location, connecting a pressure transducer means to said motor means for generating a signal which is indicative of the pressure being applied to said bit means wherein said pressure transducer means is connected through a converter for converting the signals from a pressure transducer to a frequency signal to one dedicated conductor of a multi-conductor wireline logging cable and to a filter at a control means for isolating the frequency signal and then to a frequency-to-voltage signal converter and finally to a means for monitoring the signal generated by said pressure transducer means, activating said hydraulic motor means for rotating said drilling bit and moving said drilling bit means into drilling engagement with the sidewall of the drill hole, then retracting said drilling bit means and then said shoe means and, removing said apparatus from said dril hole.

36. A method of drilling into the sidewall of a drill hole penetrating a subterranean formation which comprises:

positioning at a select location in the drill hole an apparatus for drilling through a sidewall of a drill hole, wherein said apparatus comprises a support member, a shoe means mounted to said support member for movement toward and away from the sidewall of a drill hole, a hydraulic motor means which comprises a rotor mounted to said support member for movement toward and away from the sidewall of a drill hole, and a drilling bit means connected to said rotor for drilling a hole, activating said shoe means for wedging said apparatus at said selected location followed by activating said hydraulic motor means for rotating said drilling bit and moving said drilling bit means to a drilling engagement with the sidewall of a drill hole, connecting a plurality of rotary switches through one dedicated conductor of a multi-conductor wireline logging cable to a control means and at selected switch positions to solenoid operated valves for controlling the movement of hydraulic fluid through the apparatus, wherein one of said switches is advanced by a positive or a negative direct current pulse transmitted over said dedicated conductor of a multi-conductor wireline logging cable, and the remainder of plurality of said switches are advanced by an opposite direct current, the, retracting said drilling bit means and then said shoe means and moving said apparatus from said drill hole.

37. An apparatus for drilling into the sidewall of a borehole which comprises:

a support member, a shoe means mounted on said support member, means for moving said shoe means towards and away from said sidewall, motor means supported by said support member wherein said motor means includes a hollow rotor, conveying means for moving said motor means toward and away from said sidewall, a core storage means supported by said support member adjacent to said motor means, a drilling bit means including a core retaining barrel, a core cutting bit attached to said core retaining barrel which is connected to said rotor whereby as cores are cut, they extend through said rotor of said motor means to said core storage means, means connected to support member for deflecting the end of said core retaining barrel farthest from said sidewall while said barrel is extended.

38. An apparatus for drilling into the sidewall of a borehole which comprises:

a motor means having a hollow rotor, a support member for supporting said motor means, means for moving said motor means toward and away from said sidewall, a core storage means supported by said support member adjacent said motor means, a drilling bit means including a core retaining barrel and a core cutting bit attached to said core retaining barrel which is connected to said rotor whereby as cores are cut they extend through said rotor of said motor means to said core storage means, means connected to said support member for deflecting the end of said core retaining barrel farthest from said sidewall while said barrel is extended.

39. A method of cutting a core from the sidewall of a drill hole penetrating a subterranean formation which comprises:

positioning at a selected location in the drill hole an apparatus which comprises an elongated housing means having an opening through which a shoe means can move to wedge said housing means at a location in the drill hole and an opening through which a core drilling bit means can move to cut a core from the sidewall of the drill hole, a shoe means mounted within said elongated housing means for movement through said shoe means opening in said housing means for releasably wedging said housing means at a location in the drill hole, a hydraulic motor means which comprises a rotor mounted in said housing means for movement toward and away from said drilling means opening in said housing means, and a core drilling bit means connected through a core retaining barrel means to the rotor of said hydraulic motor for cutting a core from the sidewall of the drill hole and for retaining said core, activating said shoe means for wedging said housing means at said selected location, followed by activating said hydraulic motor means for rotating said drilling bit and moving said drilling bit into drilling engagement with the sidewall of the drill hole for cutting a core from the sidewall of the drill hole, connecting a position transducer means to said motor means for generating a signal which is indicative of the position of the bit means, wherein said position transducer means is connected through a converter for converting the signals from the position transducer to a frequency signal to one dedicated conductor of a multi-conductor wireline logging cable and to a filter at control means for isolating the frequency signal and then to a signal converter and finally to a means for monitoring the signal generated by said position transducer means, retracting said core drilling bit means and said shoe means to within said housing means and removing said apparatus from said drill hole.

40. A method of cutting a core from the sidewall of a drill hole penetrating a subterranean formation which comprises:

positioning at a selected location in the drill hole an apparatus which comprises an elongated housing means having an opening through which a shoe means can move towards said housing means at a location in the drill hole and an opening through which a core drilling bit means can move to cut a core from the sidewall of a drill hole, a shoe means mounted within said elongated housing means for movement through said shoe means opening in said housing means for releasably wedging said housing means at a location in the drill hole, a motor means which comprises a rotor mounted in said housing means for movement toward and away from said drilling means opening in said housing means, and a core drilling bit means connected through a core retaining barrel means to the rotor of said motor for cutting a core from the sidewall of the drill hole and for retaining said core, activating said shoe means for wedging said housing means at said selected location, followed by activating said motor means for rotating said core drilling bit and moving said drilling bit means into drilling engagement with the sidewall of the drill hole for cutting a core from the sidewall of the drill hole, connecting a pressure transducer means to said motor means for generating a signal which is indicative of the pressure being applied to said bit means, and connecting said pressure transducer means through a converter for converting a signal from the pressure transducer to a frequency signal to one dedicated conductor of a multi-conductor wireline logging cable and to a filter at a control means for isolating the frequency signal and then to a signal converter and finally to a means for monitoring the signal generated by said pressure transducer means, retracting said core drilling bit means and said shoe means to within said housing means and removing said apparatus from said drill hole.

41. A method of cutting a core from the sidewall of a drill hole penetrating a subterranean formation which comprises:

positioning at a selected location in the drill hole an apparatus which comprises an elongated housing means having an opening through which a shoe means can move to wedge said housing means at a location in the drill hole and an opening through which a core drilling bit means can move to cut a core from the sidewall of a drill hole, a shoe means mounted within said elongated housing means for movement through said shoe means opening in said housing means for releasably wedging said housing means at a location in the drill hole, a hydraulic motor means which comprises a rotor mounted in said housing means for movement toward and away from said drilling means opening in said housing means, and a core drilling bit means connected through a core retaining barrel means to the rotor of said hydraulic motor for cutting a core from the sidewall of the drill hole and for retaining said core, activating said shoe means for wedging said housing means at said selected location, followed by activating said hydraulic motor means for rotating said core drilling bit and moving said drilling bit means into drilling engagement with the sidewall of the drill hole for cutting a core from the sidewall of the drill hole, connecting a plurality of rotary switches through one dedicated conductor of a multi-conductor wireline logging cable to a control means and at selected switch positions to solenoid operated valves for controlling the moement of hydraulic fluid through the apparatus, wherein one of said switches is advanced by positive or a negative direct current pulse transmitted over said one dedicated conductor of a multiconductor wireline logging cable, and the remainder of said plurality of switches are advanced by an opposite direct current pulse, and retracting said core drilling bit means and then said shoe means to within said housing means and removing said apparatus from said drill hole.

* * * * *